US011612190B2

(12) United States Patent
Webb

(10) Patent No.: US 11,612,190 B2
(45) Date of Patent: Mar. 28, 2023

(54) APPAREL WITH GRIP ELEMENTS

(71) Applicant: A7 Fitness Inc., Woodstock, GA (US)

(72) Inventor: Jasen L. Webb, Woodstock, GA (US)

(73) Assignee: A7 Fitness Inc., Woodstock, GA (US)

( * ) Notice: Subject to any disclaimer, the term of this patent is extended or adjusted under 35 U.S.C. 154(b) by 6 days.

(21) Appl. No.: 16/664,360

(22) Filed: Oct. 25, 2019

(65) Prior Publication Data

US 2021/0120886 A1 Apr. 29, 2021

(51) Int. Cl.
*A41B 1/08* (2006.01)

(52) U.S. Cl.
CPC ..... *A41B 1/08* (2013.01); *A41B 2400/80* (2013.01); *A41B 2500/10* (2013.01); *A41B 2500/20* (2013.01); *A41B 2500/50* (2013.01)

(58) Field of Classification Search
CPC .... A41D 13/0015; A41D 27/00; A41D 27/12; A41D 27/28; A41D 2400/80; A41D 27/10; A41F 5/00; A41B 1/08
USPC ..... 2/115
See application file for complete search history.

(56) References Cited

U.S. PATENT DOCUMENTS 3,799,416 A 3/1974 Schmaltz
3,835,470 A 9/1974 Greiter
7,748,056 B2 * 7/2010 Mickle ..... A41D 13/0518 2/115
8,281,414 B2 * 10/2012 Mickle ..... A41D 13/0518 2/115
2005/0114978 A1 * 6/2005 Benini ..... A41D 13/0151 2/69
2006/0041991 A1 * 3/2006 Kim Sim ..... A41D 19/0062 2/168
2006/0272071 A1 * 12/2006 Mickle ..... A41D 13/0518 2/69

(Continued)

FOREIGN PATENT DOCUMENTS

CA 892301 A 2/1972
CN 108471821 A 8/2018

(Continued)

OTHER PUBLICATIONS

International Search Report and Written Opinion dated Dec. 22, 2020 for PCT application No. PCT/US20/53091, 10 pages.

(Continued)

*Primary Examiner* — Gloria M Hale
(74) *Attorney, Agent, or Firm* — Lee & Hayes, P.C.

(57) ABSTRACT

A garment that includes one or more grip elements is disclosed. The grip elements, as disposed on a garment, may enable enhanced frictional forces between the garment and an object, such as exercise equipment, with which the garment may make contact. The grip elements may be composite structures disposed on one or more surfaces of the garment and may include an elastomeric and/or rubbery material with grit materials, such as sand, alumina, silicon carbide, or the like, embedded therein. The grit material may be at least partially exposed at the surface of the grip elements and may enhance gripping forces when the grip elements are wet, such as with sweat, compared to grip elements formed by only elastomeric materials. Grip elements may be formed on various portions of a garment separately and then those portions may be attached to each other to form the garment with grip elements.

20 Claims, 15 Drawing Sheets

(56) References Cited

U.S. PATENT DOCUMENTS

| | | | | |
|---|---|---|---|---|
| 2007/0220673 | A1* | 9/2007 | Nichols | D06N 7/0092 5/420 |
| 2008/0090506 | A1* | 4/2008 | Palushaj | B24D 15/045 451/538 |
| 2009/0007313 | A1* | 1/2009 | Boorsma | A41D 19/04 2/161.8 |
| 2010/0229278 | A1* | 9/2010 | Bates | A41D 13/0002 2/115 |
| 2014/0026285 | A1* | 1/2014 | Baldino | A41D 13/0015 2/69 |
| 2014/0215681 | A1 | 8/2014 | Goodman | |
| 2014/0223630 | A1* | 8/2014 | Johnson | A41D 31/18 2/69 |
| 2015/0273310 | A1* | 10/2015 | Johnston | A41D 1/04 2/16 |
| 2016/0286870 | A1* | 10/2016 | Capla | A41D 1/084 |
| 2017/0013888 | A1 | 1/2017 | Webb | |
| 2017/0055600 | A1* | 3/2017 | Hawkins | A41D 13/0002 |
| 2017/0160058 | A1* | 6/2017 | Limpisvasti | F41H 1/02 |
| 2017/0318879 | A1* | 11/2017 | Gleser | A61B 42/50 |
| 2018/0098587 | A1* | 4/2018 | Moore | A43B 23/0205 |

FOREIGN PATENT DOCUMENTS

| | | | |
|---|---|---|---|
| EP | 1426481 | B1 | 6/2004 |
| WO | WO2003/015549 | A1 | 2/2003 |

OTHER PUBLICATIONS

Pakistani Office Action dated Mar. 18, 2021 for Pakistani Patent Application No. 693/2020, a foreign counterpart of U.S. Appl. No. 16/664,360, 2 pages.

Pakistan Office Action dated Dec. 29, 2021 for Pakistan Patent Application No. 693/2020, a foreign counterpart to U.S. Appl. No. 16/664,360, 2 pages.

Taiwanese Office Action dated Dec. 29, 2021 for Taiwanese Patent Application No. 109135580, a foreign counterpart to U.S. Appl. No. 16/664,360, 15 pages.

International Preliminary Report on Patentability for PCT Application No. PCT/US20/53091, dated May 5, 2022, 8 pages.

* cited by examiner

900

930

940

950
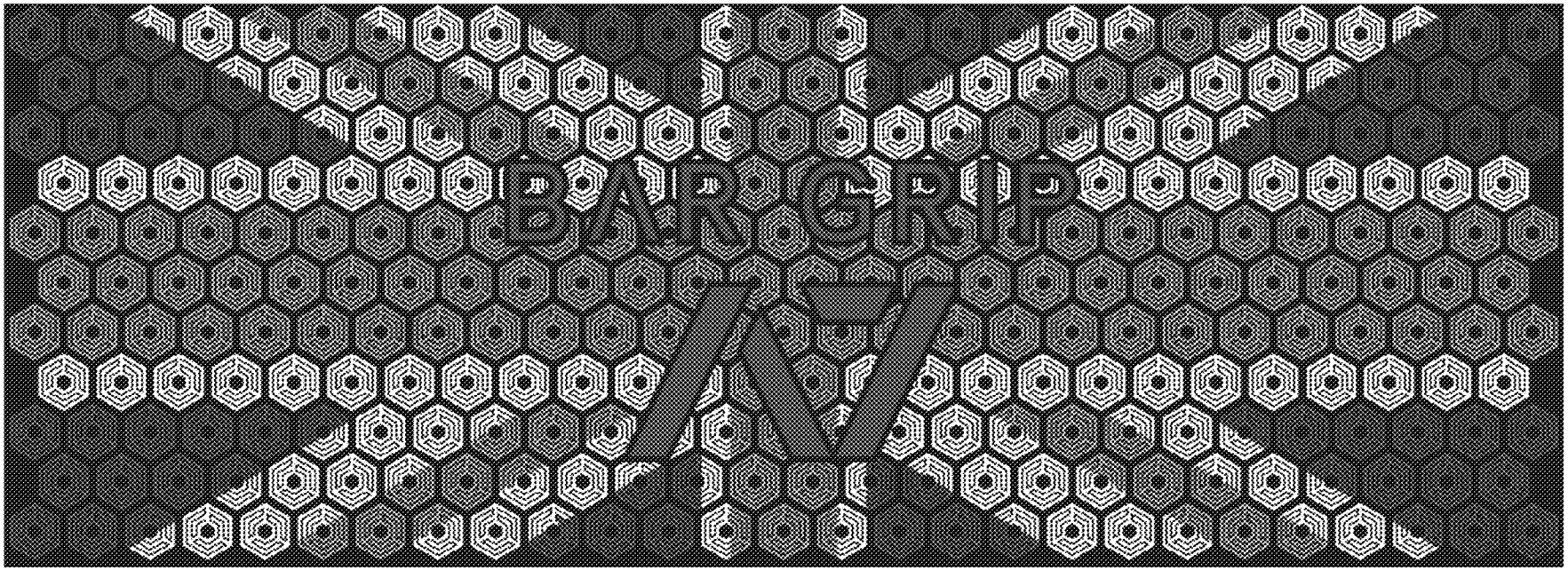

960

APPAREL WITH GRIP ELEMENTS

CROSS REFERENCE TO RELATED APPLICATIONS

This application is related to U.S. application Ser. No. 15/214,110 filed Jul. 19, 2016, entitled Functional and Aesthetic Frictional Support" and International Application No. PCT/US2020/053091 filed Oct. 25, 2019, entitled "Apparel with Grip Elements," both of which are commonly owned by A7 Fitness Inc.

BACKGROUND

During exercise, such as weight lifting or bench pressing, a person may slip or slide relative to exercise equipment that he or she may be using. This may reduce the person's performance and/or reduce the effectiveness of the exercise being performed. In general, slipping relative to gym equipment during competition or training reduces the effectiveness and/or enjoyability of the exercise being performed.

Often times a person may slip relative to exercise equipment (e.g., a bar, a weight, a bench, etc.) at a point where his or her clothes contact the exercise equipment. In other words, there may be insufficient frictional force between one's apparel and the exercise equipment. There may be even less frictional force with exercise equipment when the apparel is wet, such as due to sweating.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

FIGS. 9A-9G illustrate diagrams of various patterns of grip elements that may be disposed on an apparel, in accordance with example embodiments of the disclosure.

DETAILED DESCRIPTION

Figure 1:
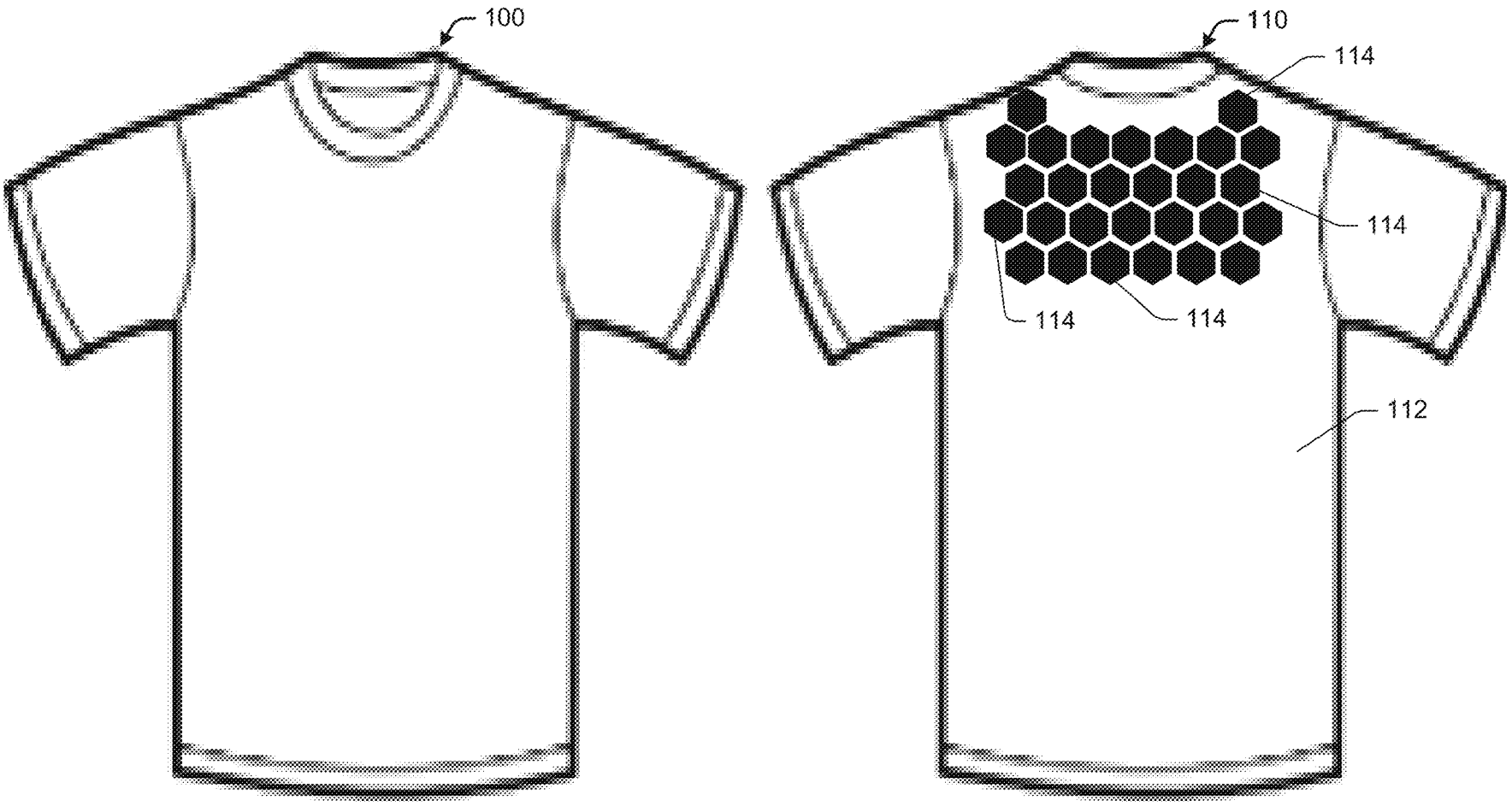
FIG. 1 illustrates a schematic diagram of an example front portion and back portion of a shirt with grip elements disposed on the back of the shirt, in accordance with example embodiments of the disclosure.

Example embodiments of this disclosure include apparel and/or garments with grip elements disposed thereon. These grip elements may enhance frictional force between the garment and objects, such as exercise equipment. The grip elements, according to example embodiments, may be formed as a composite structure, having more than one material. For example, the grip elements may be constructed with grit embedded in silicone, plastisol, or other elastomeric material. This type of grip element may provide an enhanced level of frictional force with an object compared to grip elements constructed from a single material, such as silicone by itself. In example embodiments, the composite grip elements, as discussed herein, may provide enhanced frictional force between an apparel and an object compared to other grip elements or an apparel without grip elements when the apparel is wet or moist, such as with body sweat.

In some example embodiments, grip element(s) may be disposed on one portion of an apparel, such as on the backside of a t-shirt. In other example embodiments, the grip elements may be disposed on multiple portions of an apparel, such as a front, back, and sides of a pant. In some cases, the grip elements may be formed on a portion of an apparel and then attached to another portion of the apparel to form the apparel with the grip elements. For example, grip elements may be formed on a back portion of a t-shirt and then the back portion may be attached to a front portion of the t-shirt to form the t-shirt.

According to some example embodiments, an apparel may include different types of grip elements, such as composite grip elements and single-material grip elements. For example, a hoodie may include different types of grip elements, where some of the grip elements are silicone or rubber grip elements and the other grip elements are silicone or rubber with grit embedded therein. Thus, a garment may include two different types of grip elements, where some grip elements may include grit materials and other grip elements may not include grit materials.

In some example embodiments, there may be grip elements disposed on a garment where different grit materials may be used within the grip elements. For example, a t-shirt may include a pattern of grip elements where some of the grip elements include grit materials with sharp edges and other grip elements include grit materials with rounded edges. In still other example embodiments, there may be grip elements disposed on a garment where the grip elements include different types of grit therein. For example, a pair of pants may include some grip elements that include grit in the form of sand, and other grip elements that include grit elements in the form of alumina ($Al_2O_3$).

In example embodiments, when grip elements of different types are disposed on a garment, the different types of grip elements may be of different shapes. For example, grip elements including grit may have a larger surface area than grip elements without grit embedded therein. Alternatively, grip elements including grit may have a smaller surface area than grip elements without grit embedded therein. Additionally, or alternatively, if two different grit materials in two different respective grip elements are disposed on a garment, one type of grit element may be formed with a greater surface area than the other. In some cases, a larger grip element surface area may result in reduced levels, or at least reduced perceptible levels, of edge inconsistency and/or pattern inconsistency of the grip element that may result from clumping of the grit.

In some example embodiments, a grip element may be disposed on an apparel, where the grip element may have a portion with grit embedded therein and another portion without grit. For example, a grip element may be in the form of a solid shape, where an inner portion of the grip element may include grit and an outer portion of the grip element may be free of grit. In some cases, disposing grit on an inner portion of a grip element and not on the edges may result in reduced edge roughness and/or inconsistencies that may arise from clumping of grit on the edges of the grip elements.

The grip elements, according to example embodiments, may be formed on a portion of a garment by applying one or more layers of an elastomeric material to the portion of the garment. This elastomeric material may be, for example, plastisol, silicone, rubber, neoprene, latex, isoprene containing compounds, other elastomeric compounds, siloxane foams, butyl rubber, ethylene-vinyl acetate, nitrile rubber, polyvinyl chloride (PVC) suspensions, combinations thereof, or similar materials. Once a predetermined number of layers of the elastomeric material is disposed on the garment, grit material may be applied on top of the elastomeric material. The grit material may include materials that may be abrasive, rough, gritty, relatively small, and/or materials that generally increase the frictional force (e.g., increase the static coefficient of friction) with objects that it contacts. This grit material may be sand, ceramic particles, engineered particles, metallic oxides, and/or similar materials. Once the grit material is applied, one or more additional layers of elastomeric material may be formed over the grit material disposed over prior layers of elastomeric material. In this way, the grit material is embedded and held within the elastomeric material and, in some cases, protruding from the surface of the formed grip element disposed on the portion of the apparel.

Grip elements, according to example embodiments, may be provided on any suitable apparel material, such as cotton, lycra, spandex, nylon, rayon, compression wear fabrics, linen, hemp-based fabrics, or any suitable fabric and/or clothing material. In some cases, different portions of the apparel may be constructed of different types of fabric. As further embodiments, different fabrics may have variations of mechanisms with which to provide the grip elements thereon. For example, different fabrics may have a different number of base layers (e.g., silicone material) disposed thereon, prior to providing grit material to form a grip element.

In some cases, the base material (e.g., polymeric material, elastomeric material, etc.) may be deposited by screen printing. For example, fluidic elastomeric material (e.g., liquid plastisol, liquid silicone, etc.) may be squeezed through a patterned screen aligned to a portion of an apparel on which the grip elements are to be formed. This fluidic elastomeric material may then be cured (e.g., thermal cure, ultraviolet (UV) cure, etc.) to form a layer of a base material, such as a layer of elastomeric base material. In some cases, the fluidic elastomeric material may be partially cured and fully cured at a later point in time. The base material, or the layers of elastomeric material formed prior to depositing the grit material, of the grip element may be formed by one or more layers of the liquid elastomeric material. For example, after forming a first layer of base material, another layer of the base material may be formed over the first layer of base material in a similar way, by aligning and screen printing liquid elastomeric material over the first layer of base material, followed by a curing process. In this way, any number of layers of base material may be formed on the portion of the apparel.

In example embodiments, grit may also be deposited over base material to form the grip elements by using screen printing. For example, dry grit and/or grit in suspension (e.g., a slurry) may be screen printed (e.g., deposited through a patterned screen) onto portions of base material already formed on the portion of the apparel by the mechanisms described herein. The grit may stick to the base material, in example embodiments, due to the tackiness of the surface of the grip material. Additionally, the portion of apparel on which grit is screen printed onto base material may not be moved in orientation relative to the normal direction of the earth. Thus, the force of gravity on the grit material and/or frictional forces may cause the grit material to not move relative to the base material. Next, an additional one or more layers of elastomeric material, as overlying elastomeric material may be screen printed over the grit material, such as by the mechanisms discussed herein. In this way, the grit materials may become embedded within and/or held by the elastomeric material of the base layer(s) and the overlying layer(s) to form the grip element on the portion of the apparel.

There may be variations to how the elastomeric material is formed on the portion of the apparel, according to example embodiments. For example, instead of screen printing, one or more layers of the elastomeric material may be deposited by a printing process, similar to an ink jet printer. In other example embodiments, preformed patterns of the base material may be formed separate from the portion of the apparel and then aligned and attached to the surface of the fabric, such as by using a thermal process. Indeed, any suitable process may be used for depositing the elastomeric materials onto a garment and/or for curing the elastomeric materials.

There may also be variations to how the grit material is provided on the garment. For example, the grit material may be applied even before any base layer is formed on the garment. In this case, the elastomeric material may be applied over the grit material provided on the portion of the apparel to hold and/or embed the grit material. As another example, grit material may be sprinkled over the surface of the portion of the apparel without the use of a patterned screen and may stick to where there is pre-existing elastomeric material. Excess grit may be brushed, blown, shaken, and/or washed off of the garment after the final manufacture of the apparel. In a similar embodiment, the grit material may again be dispersed over the surface of the portion of the apparel without a patterned screen and only the places that are then screen printed with a layer of base material will be the locations where the grit material sticks and is embedded in the elastomeric material to form the grip element(s). Grit material from other portions of the garment may be brushed, blown, shaken, and/or washed off After the grip elements are formed on the portion of the apparel, the portion of the apparel may be attached with one or more other portions of the apparel to form the apparel. For example, grip elements may be formed, as described herein, on a backside portion of a t-shirt and then sewed on to a front side portion of the t-shirt to form the t-shirt with grip elements provided thereon. In some cases, more than one portion of the apparel may have grip elements formed thereon. For example, a pair of pants may have grip elements both on the front of the pants and on the back of the pants.

In example embodiments, the grip elements may be formed by deposition of different types of elastomeric materials. For example, a three-step process may involve forming a patterned layer of a first elastomeric material, a patterned layer of a second elastomeric material, and then a patterned layer of a third elastomeric material. This process, in some cases, may form grip elements without any grit embedded therein. In other cases, grit material may be deposited over this tri-layer of elastomeric material, followed by forming one or more additional elastomeric material layers to embed the grit. In other words, this multi-layer (e.g., tri-layer) process may be used to make grip elements with or without grit embedded therein. In this process, the first layer may be a silicone clear base epoxy layer, second layer may be a glossy jelly layer and/or a glossy polymer/elastomeric layer, and the third layer may be a plastisol ink layer. The number and order of these layers a just one example, and it should be understood that there may be any suitable number of layers, types of materials, and/or order of layers.

In some cases, grip elements may be formed on an inner portion of a garment and an outer portion of a garment. For example, a grip shirt may have grip elements formed on the inside that contacts a wearer's skin and grip elements on the outside that may contact other objects, such as exercise equipment. The grip elements disposed on the inside of a garment may lack the grit material to provide a comfortable feel for the wearer, while the grip elements on the outside may include the grit material to enhance frictional forces with other objects. The forming of the grip elements on the inside (e.g., apparel surface that is in contact with the wearer's body) and outside (e.g., apparel surface that is opposing the inside apparel surface) of the apparel may entail forming grip elements on one side of a portion of the apparel and then forming additional grip elements on the opposing side of the portion of the apparel.

In some example embodiments, the grip elements with grit may be formed by pre-mixing grit material with liquid elastomeric material or elastomeric precursor epoxy to make a grip mixture or grip epoxy. For example, sand may be mixed with liquid silicone. This grip epoxy may then be disposed on a portion of an apparel, such as according to a pattern, and then cured to form the grip elements with grit. The concentration of grit in the base material may be any suitable concentration, such as, for example, about 10% by volume. The cure process may be by any suitable mechanism, such as thermal cure, evaporative cure, radiation-based (e.g., ultraviolet (UV) radiative) cure, etc.

In some example embodiments, the grip elements may include super absorbent materials, such as superabsorbent polymers like hydrogels, acrylonitrile, polyacrylate, polyacrylamide, polyacrylamide copolymer, ethylene maleic anhydride copolymer, cross-linked carboxymethylcellulose, polyvinyl alcohol copolymers, cross-linked polyethylene oxide, combination thereof, or the like. The inclusion of the super absorbent material in the grip elements, such as within the elastomeric material, may allow the grip elements to absorb liquids, such as sweat of the wearer. This sweat can then evaporate out from the grip elements, such as in a clothes dryer, prior to subsequent use of the apparel. During use, the wearer may feel comfortable due to the grip elements with super absorbent materials pulling away and/or trapping moisture from the wearer's skin.

FIG. 1 illustrates a schematic diagram of an example front portion 100 and a back portion 110 of a shirt with grip elements 114 disposed on the back portion 110 of the shirt, in accordance with example embodiments of the disclosure. In example embodiments, one or more, or all, of the grip elements 114 may include grit therein.

Thus, in some example embodiments, only grip elements 114 with grit embedded therein may be formed on a surface 112 of the back portion 110 of the shirt. In other example embodiments, only grip elements 114 with no grit embedded therein may be formed on the surface 112 of the back of the shirt. In still other example embodiments, some of the grip elements 114 formed on the surface 112 of the back portion of the shirt may include grit embedded therein, while others of the grip elements 114 may not include any grit.

As described herein, the grip elements 114 may be formed on the back portion 110 of the shirt and then the back portion 110 is attached, such as by sewing to the front portion 100 of the shirt. In this way, different portions of an apparel may have grip elements formed thereon separately and then those various portions of the apparel may be attached together to form the final apparel. A shirt, as formed in two separate portions, is shown here only as an example. Grip elements may be provided on any variety of suitable apparel, such as pants, hoodies, compression gear, socks, gloves, undershirts, sweatshirts, sweatpants, jumpers, jackets, combinations thereof, or the like. Additionally, the apparel may be formed using any suitable number of separately fabricated portions. For example, a hoodie may be formed by attaching three separate portions including a front portion, a back portion, and a hoodie portion, where any of the portions may include grip elements as described herein.

The grip elements 114 may be formed by any suitable variety of mechanisms onto the back portion 110 of the shirt. In some cases, one or more layers of base material (e.g., silicone, plastisol, etc.) may be patterned, such as by screen printing, onto the backside portion 110. The base material may be disposed as liquid (e.g., pre-cured epoxy), such as liquid silicone, through a patterned screen of a screen printing mechanism, followed by either a partial or full cure of the base material. For example, the base material may be formed as hexagonal features, a collection of which is disposed in a honeycomb pattern, as shown. However, this is an example pattern and the base material may be applied onto the backside portion 110 in any suitable pattern. Next, grit material may be disposed over the base material, and then one or more additional layers of base material may be patterned and formed over the grit material to form the grip elements 114 with grit material embedded therein.

In another example embodiment, base material epoxy and grit material may be premixed into an epoxy mixture or grip element mixture. The epoxy mixture may be patterned onto the backside portion 110, such as in the patterns shown. In other words, the epoxy mixture may be provided on the surface 112 of the backside portion 110 as hexagonal features configured as a honeycomb pattern. However, this is an example pattern and the epoxy mixture may be applied onto the backside portion 110 in any suitable pattern. After depositing the epoxy mixture, the epoxy mixture may be cured to form the grip elements 114 with grit material embedded therein.

In some example embodiments, the some of the grip elements 114 may include grit material, while others of the grip elements 114 may not include grit material therein. In one non-limiting example, some of the outer grip elements 114 on the surface 112 of the backside portion 110 may include grit material, while the inner grip elements may not include grit elements. In another non-limiting example, the grip elements 114 may alternate between including grit material and not including grit material. Indeed, any suitable disposition of grit including and non-grit grip elements 114 may be contemplated, according to example embodiments of the disclosure.

In some example embodiments, the grip elements 114 may not have grit material over the entirety of their overall surface area. For example, the grip elements 114 may have edge exclusion zones where its inner portions may include grit material, but grit material may not be provided proximal to the edges of the grip elements 114. In these embodiments, the patterns (e.g., screen print patterns) for depositing the grit material may be a different geometry (e.g., reduced aerial footprint) than the patterns for depositing the base material and/or epoxy, such as for epoxy underlying the grit material and/or for epoxy partially overlying the grit material. In example embodiments, the grip elements may have a grit edge exclusion zone, defining a distance from the edges of the grip elements 114 where grit material is not included, in the range of about 0.5 millimeters (mm) to about 100 mm. For example, grip elements 114 may be formed where the grit edge exclusion may be about 5 mm, such that grit material may be embedded near the center of the grip elements 114, but not within 5 mm of the edge of the grip elements 114. As discussed herein, the grit edge exclusion may result in reduced clumping of grit material and/or reduced levels of edge roughness of the grip elements 114.

In some example embodiments, the collection of grip elements 114 may form a pattern on the surface 112 of the backside portion 110 of the garment. The pattern may be designed to have a location that is suitable for the type of exercise that someone wearing the garment may engage in. For example, the pattern on the backside portion 110, as shown, may be suited to various weightlifting exercises, where a bar may be placed on the shoulders (e.g., squats) or where one may desire high levels of friction while lying on his or her back (e.g., bench press). Weightlifting is one type of exercise for which the embodiments described herein are suitable. It will be appreciated that the garments with grip elements, as described herein, are suitable for a variety of different types of exercise and activities. It should further be understood that some garments and the location of the grip elements 114 thereon may be designed and targeted for particular exercise(s). For example, pants and shirts may be designed for a dead-lift exercise where the front upper-thigh location of the pants, as well as the chest location of the shirts, has grip elements disposed thereon.

In further example embodiments, an aerial density of the pattern, as well as the distance between grip elements 114, may be designed to provide relatively high levels of breathability, while enabling relatively high frictional forces with contacting exercise objects. In other words, spaces with and without elastomeric material may be designed in a manner where there is sufficient air flow from the wearer's body outward and from the surroundings inward through the fabric where no grip elements 114 are disposed to provide comfort to the wearer. Thus, in example embodiments, the aerial density of the grip elements 114 are not too great to cause discomfort to the wearer and not too low to provide insufficient frictional force on contacting exercise equipment. In some example embodiments, patterns may have an aerial density (e.g., the percentage of the area defined by the boundary of the collection of grip elements that is covered by the grip elements) in the range of about 20% to about 100%. In additional example embodiments, the aerial density may be in the range of about 30% to about 70%. In yet other example embodiments, the aerial density may be in the range of about 35% to about 60%. In some cases, the grip elements 114 themselves may have open regions therein, to reduce the aerial density of the grip elements 114 and improve breathability of the garment and/or the comfort of the wearer. The aerial density ranges of the grip elements 114 are examples, and the disclosure herein contemplates any suitable range of aerial density of the grip elements 114.

The grip elements 114 may protrude from the surface 112 by any suitable thickness. In some example embodiments, the grip elements 114 may have a thickness in the range of about 0.05 millimeters (mm) to about 10 mm. In additional example embodiments, the grip elements 114 may have a thickness in the range of about 0.10 mm to about 5 mm. In yet other example embodiments, grip elements 114 may have a thickness in the range of about 0.15 mm to about 1 mm.

Figure 2:
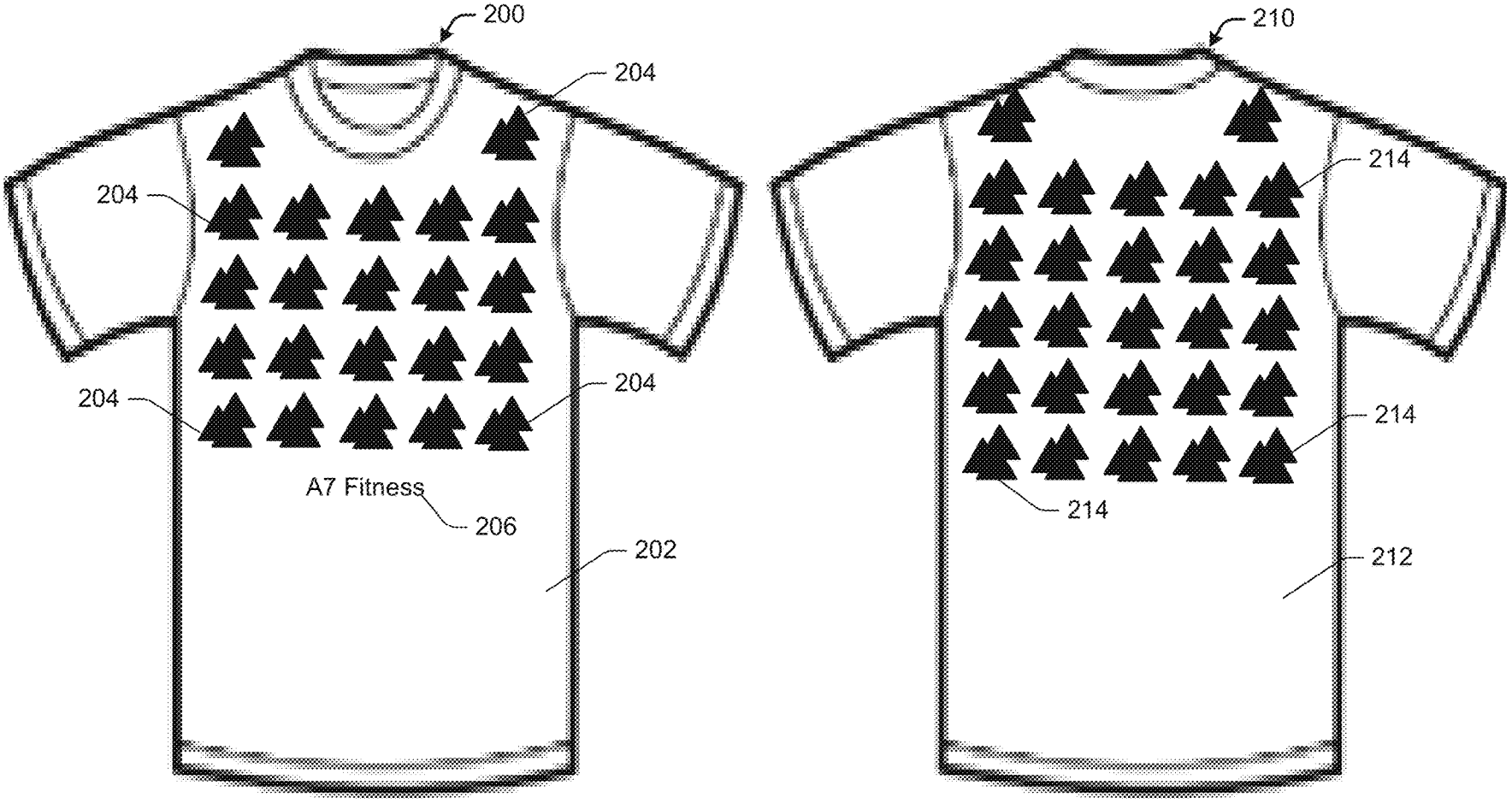
FIG. 2 illustrates a schematic diagram of an example front portion and back portion of a shirt with grip elements disposed on both the front of the shirt and the back of the shirt, in accordance with example embodiments of the disclosure.

FIG. 2 illustrates a schematic diagram of an example front portion 200 and back portion 210 of a shirt with grip elements 204, 206, 214 attached to both the front portion 200 of the shirt and the back portion 210 of the shirt, in accordance with example embodiments of the disclosure. As described with reference to FIG. 1, some or all of the grip elements 204, 206, 214 may have grit embedded therein. Alternatively, none of the grip elements 204, 206, 214 may have grit embedded therein. In some cases, the grip elements 204, 214 may be repeating geometric pattern, as shown, while grip element 206 may be in the form of text. In other cases, the grip elements 204, 206 disposed on a surface 202 of the front portion 200 may not include grit, while the grip elements 214 on a surface 212 of the back portion 210 may have grit embedded therein, or vice-versa. In yet other cases, every other one of the grip elements 204, 214 may include grit therein, while textual grip elements 206 may not include grit material therein.

As described herein, the grip elements 204, 206 may be formed on the front portion 100 and the grip elements 214 may be formed on the back portion 210 and then the front portion 200 may be attached to the back portion 210, such as by sewing the back portion 210 to the front portion 200 of the shirt. In this way, different portions of an apparel may have grip elements formed thereon separately and then those various portions of the apparel may be attached together to form the final apparel. A shirt, as formed in two separate portions, is shown here only as an example. Grip elements may be provided on any variety of suitable apparel, such as pants, hoodies, compression gear, socks, gloves, undershirts, sweatshirts, sweatpants, jumpers, jackets, combinations thereof, or the like. Additionally, the apparel may be formed using any suitable number of separately fabricated portions. For example, a jacket may be formed by attaching four separate portions including a front portion, a back portion, and two side portions, where any of the portions may include grip elements as described herein.

The grip elements 204, 206, 214 may be formed by any suitable variety of mechanisms onto portions 200, 210 of the shirt. In some cases, one or more layers of base material (e.g., silicone, plastisol, etc.) may be patterned, such as by screen printing and/or rastered ink jet printing. The base material may be disposed as liquid (e.g., pre-cured epoxy), such as liquid silicone, through the screen of a screen printing mechanism or an ink jet nozzle, followed by either a partial or full cure of the base material. For example, the base material may be formed as triangular features 204, 214 or as text 206, as shown. However, this is an example pattern and the base material may be applied onto the portions 200, 210 in any suitable pattern. Next, grit material may be disposed over the base material, and then one or more additional layers of base material may be patterned and formed over the grit material to form the grip elements 204, 206, 214 with grit material embedded therein.

In another example embodiment, base material epoxy and grit material may be premixed into an epoxy mixture or grip element mixture. The epoxy mixture may be patterned onto the surface 202 of the front portion 200 and the surface 212 of the back portion 210, such as in the patterns shown. In other words, the epoxy mixture may be provided on the surface 202 of the front portion 200 as both overlapping triangle features configured in a row and column pattern, as well as text, and separately, the epoxy mixture may be provided on the surface 212 of the back portion 210 as overlapping triangle features configured in row and column pattern configured in the row and column pattern. However, this is an example pattern and the epoxy mixture may be applied onto the front portion 200 and/or back portion 210 in any suitable pattern. After depositing the epoxy mixture, the epoxy mixture may be cured to form the grip elements 204, 206, 214, with grit material embedded therein.

Figure 3:
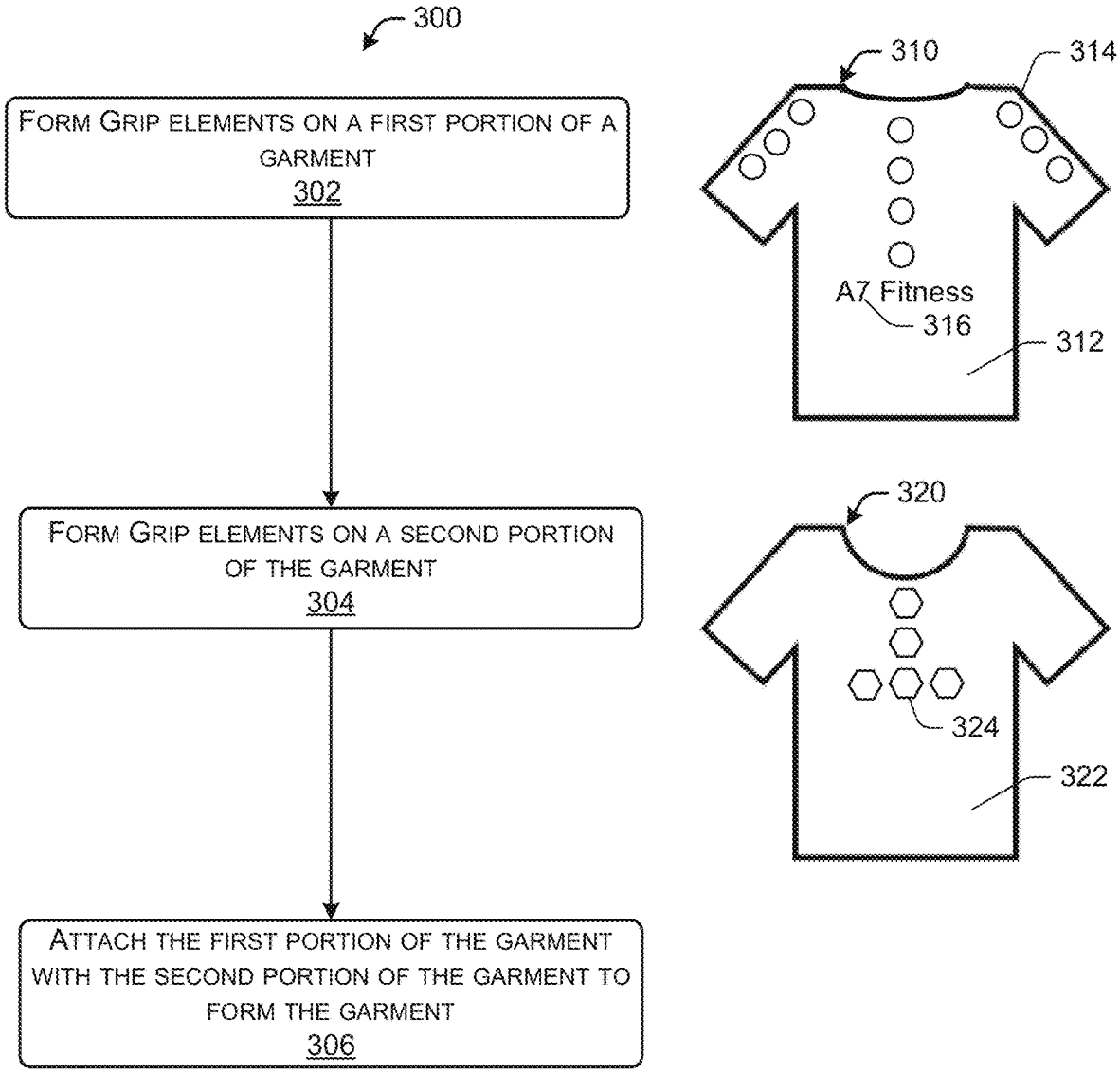
FIG. 3 illustrates a flow diagram of an example method by which a garment with grip elements may be fabricated, in accordance with example embodiments of the disclosure.

FIG. 3 illustrates a flow diagram of an example method 300 by which a garment with grip elements may be fabricated, in accordance with example embodiments of the disclosure. This method 300, in example embodiments, may be performed by one or more entities (e.g., different manufacturers) in one or more facilities (e.g., clothing factories).

At block 302, grip elements 314, 316 may be formed on a first portion 310 of a garment. For example, the first portion 310 of the garment may be a backside of a shirt. This is an example, and the garment may be any suitable garment to which grip elements may be provided. The first portion 310 of the shirt may have a surface 312 on which one or more grip elements 314, 316 may be formed. As shown, the grip elements 314, 316 may be in the form of patterns and/or text. The grip elements 314, 316 may be formed by any suitable process, such as screen printing, ink jet printing, painting, or the like.

As discussed herein, the grip elements 314, 316 may be formed by depositing one or more layers of base epoxy resin and/or plasticizing emulsion material on the surface 312 of the first portion 310 of the garment and curing those layers of base epoxy resin to form a base elastomeric material. As used herein, elastomeric material may, in some cases, refer to cured plasticizing emulsion materials and/or rubber-like epoxy resins, such as plastisol, silicone, rubber, neoprene, latex, isoprene containing compounds, other elastomeric compounds, siloxane foams, butyl rubber, ethylene-vinyl acetate, nitrile rubber, polyvinyl chloride (PVC) suspensions, combinations thereof, or similar materials. Grit material, such as sand, alumina, silica, silicon carbide, engineered materials, or the like may be deposited over at least a portion of the cured base elastomeric material. Additional elastomeric material layers may be formed over the grit material, thereby embedding the grit material within elastomeric material.

As discussed herein, the epoxy resins and/or plasticizing emulsion materials may be deposited on the surface 312 by ay suitable process including, but not limited to, screen printing, ink jet printing, spray through a nozzle, extrusion through a template, combinations thereof, or the like. The process for forming the base layer(s) (e.g., formed prior to deposition of the grit material) of elastomeric materials may be performed by the same (e.g., screen printing) or different processes relative to forming the overlayer(s) (formed after depositing the grit material) of elastomeric materials. The grit material may be deposited over the base elastomeric material by any suitable process, such as screen printing, ink jet printing, spray through a nozzle, scattering, depositing a slurry including the grit material, combinations thereof, or the like.

In some cases, the grip elements 314, 316 may be formed on the surface 312 by patterning a premixed suspension of grit material and elastomeric precursor materials, such as epoxy resins and/or plasticizing emulsion with the grit mixed therein. The grip elements 314, 316 formed with this premixed suspension may be formed in one layer (e.g., single pass deposition and cure) or as multiple stacked layers. For example, the premixed suspension may be deposited in a patterned manner on the first portion 310, such as by silk screening, and then cured, such as by thermal cure at an elevated temperature.

The first portion 310 of the garment may be made of any suitable material or fabric, such as cotton, lycra, wool, rayon, polyester, nylon, spandex, flannel, silk, denim, natural fiber, cellulose fiber, synthetic fiber, woven cloth, knitted cloth, compression wear fabrics, linen, hemp-based fabrics, combinations thereof, or the like. The fabric of the garment may further be dyed with any suitable dye or combinations of die. In some cases, the fabric may be dyed by any suitable mechanism prior to forming the grip elements 314, 316 thereon. In other cases, the fabric may be dyed after forming the grip elements 314, 316 thereon. The grip elements 314, 316 may be formed to have different colors. Thus, the elastomer forming precursors (e.g., elastomeric resins, epoxy resins, plasticizing emulsion materials, etc.) used to form the elastomeric base features and/or the elastomeric overlying features may include dyes therein. Different colors of the grip elements 314, 316 on the first portion 310 may be formed separately on the surface 312. For example, a base elastomeric feature may be formed, grit deposited over the base elastomeric feature, and an overlying elastomeric feature may be formed for a blue grip element 314, 316, where the elastomer forming precursor may include blue dye. Next the same processes may be repeated to form a red grip element 314, 316, where the elastomer forming precursor may include red dye.

At block 304, grip elements may be formed on a second portion of a garment. As an example, the second portion 320 of the garment may be a front portion of the shirt. The second portion 320 of the shirt may have a surface 322 on which one or more grip elements 324 may be formed. This process may be optional, as in some cases, only one portion of the garment may have grip elements disposed thereon. The grip elements 324, as formed on the second portion 320, may be formed in a similar manner as the grip elements 316, 316 formed on the first portion 310. In some cases, the grip elements 324 may be formed by a different process than the mechanism for forming the grip elements 314, 316. For example, some grip elements 314, 316, 324 may be formed by forming a base elastomeric feature, depositing the grit material, and then forming an overlying elastomeric feature, while other of the grip elements 314, 316, 324 may be formed by using a premixed suspension of grit in elastomeric precursor material.

At block 306, the first portion of the garment may be attached to the second portion of the garment to form the garment. Any suitable mechanism may be used for attaching the first portion 310 to the second portion 320, such as sewing, gluing, by mechanical fasteners, clips, bolts, zippers, pins, combinations thereof, or the like. As an example, the first portion 310 may be sewed onto the second portion 320 along their edges to form the garment in the form of a t-shirt with grip elements.

It should be noted that some of the operations of method 300 may be performed out of the order presented, with additional elements, and/or without some elements. Some of the operations of method 300 may further take place substantially concurrently and, therefore, may conclude in an order different from the order of operations shown above.

Figure 4:
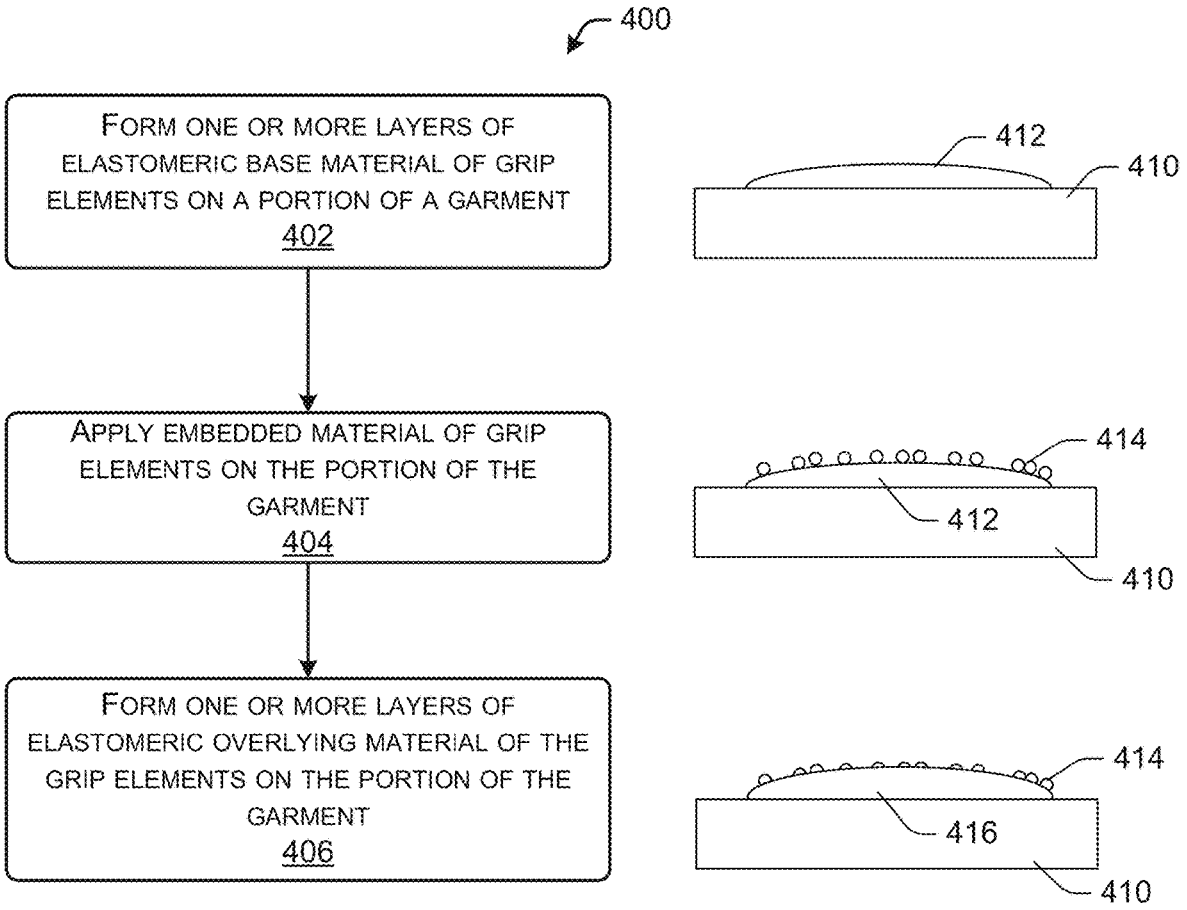
FIG. 4 illustrates a flow diagram of an example method for forming grip elements on a portion of a garment, in accordance with example embodiments of the disclosure.

FIG. 4 illustrates a flow diagram of an example method 400 for forming grip elements on a portion of a garment, in accordance with example embodiments of the disclosure. This method 400, in example embodiments, may be performed by one or more entities (e.g., different manufacturers) in one or more facilities (e.g., clothing factories). The method 400 may be used to form grip elements on fabric, such as in the processes of blocks 302, 304 of method 300, as depicted in FIG. 3.

At block 402, one or more layers of elastomeric base material of grip elements may be formed on a portion of a garment. As an example, in cross-sectional view, elastomeric base material 412 may be formed on top of a fabric 410 of a portion of a garment. This elastomeric base material 412 may be, for example, plastisol, silicone, rubber, neoprene, latex, isoprene containing compounds, other elastomeric compounds, siloxane foams, butyl rubber, ethylene-vinyl acetate, nitrile rubber, PVC, combinations thereof, or similar materials. The number of layers of elastomeric material deposited to form the base material 412 may be any suitable number, such as a single layer or three layers, for example.

The elastomeric base material 412, according to example embodiments, may be provided on any suitable apparel material or fabric 410, such as The first portion 310 of the garment may be made of any suitable material or fabric, such as cotton, lycra, wool, rayon, polyester, nylon, spandex, flannel, silk, denim, natural fiber, cellulose fiber, synthetic fiber, woven cloth, knitted cloth, compression wear fabrics, linen, hemp-based fabrics, combinations thereof, or the like. The fabric 410 of the garment may further be dyed with any suitable dye or combinations of die prior to the formation of the one or more layers of elastomeric base material 412 thereon. In some cases, different fabrics may have variations of mechanisms with which to provide the grip elements thereon. For example, different fabrics may have a different number of elastomeric base layers (e.g., silicone base material, plastisol base material, etc.) disposed thereon to form the one or more layers of elastomeric base material 412.

In some cases, the one or more layers of elastomeric base material 412 may be deposited by screen printing. For example, fluidic elastomeric precursor material may be squeezed through a patterned screen aligned to fabric 410 and then cured to form a layer of elastomeric base material. The fluidic elastomeric precursor material may include elastomeric resins, epoxy resins, plasticizing emulsion materials, combinations thereof, or the like. In some cases, the fluidic elastomeric precursor material may include plasticizing material, as well as volatile materials (e.g., solvents) that may volatilize (e.g., evaporate) during a cure process.

The elastomeric precursor material may have a viscosity suitable for deposition onto the fabric 410, such as via silk screening and/or nozzle dispense, and subsequent staging prior to cure. For example, the elastomeric precursor material may have a viscosity that is low enough to be squeezed through a patterning silk screen or through an aperture of a nozzle, such as an ink jet nozzle. However, the viscosity of the elastomeric precursor material may also be great enough so that the elastomeric precursor material may stage properly, without dispersing and/or bleeding into the fabric 410, prior to curing the elastomeric precursor material to from a layer of the elastomeric base material. In some example embodiments, the viscosity of the elastomeric precursor material may be in the range of about 500 centipoise (cP) to about 50,000 cP. In further example embodiments, the viscosity of the elastomeric precursor material may be in the range of about 2000 cP to about 35,000 cP. In still further example embodiments, the viscosity of the elastomeric precursor material may be in the range of about 10,000 cP to about 30,000 cP. In some example embodiments, the elastomeric precursor material may be plastisol. In other example embodiments, the elastomeric precursor material may be silicone.

In some example embodiments, the elastomeric precursor material may exhibit thixotropic or other non-Newtonian properties during screen printing and/or nozzle extrusion. As a result of its thixotropic nature, the elastomeric precursor material may temporarily have a reduced viscosity during deposition, but have a greater viscosity during staging on the fabric 410, prior to cure. In some example embodiments, thixotropic elastomeric precursor material may be used during the deposition process for its preferential rheological properties of reduced viscosity during deposition and increased viscosity during staging. In some cases, the rheological properties of the elastomeric precursor material may be engineered, such as by controlling the relative concentrations of elastomeric materials, solvents, etc. within the elastomeric precursor material. In this way an elastomeric precursor material may be used that is suitable for the screen printing and/or nozzle extrusion properties associated with the deposition process of the elastomeric precursor material. For example, the elastomeric precursor material may be engineered for rheological properties that are relatively tuned for a desired screen aperture size and/or squeegee rate during the screen printing process.

According to some example embodiments, the Van der Waals forces and/or the surface wetting properties of the elastomeric precursor material may be such that the elastomeric precursor material sticks to the surface of the fabric 410, but does not wick into and/or through the fabric 410 excessively. Thus, in example embodiments, the elastomeric precursor material may be engineered such as by controlling the relative concentrations of elastomeric materials, solvents, etc. within the elastomeric precursor material, to provide a desired contact angle between the elastomeric precursor material and the surface of the fabric 410. In some cases, the surface of the fabric 410 may be treated (e.g., with application of a surface coating) to enable a desired contact angle between the elastomeric precursor material and the surface of the fabric 410, and the associated wetting, during staging of the elastomeric precursor material on the fabric 410.

In some example embodiments, the elastomeric precursor material may include superabsorbent materials, such as superabsorbent polymers like hydrogels, acrylonitrile, polyacrylate, polyacrylamide, polyacrylamide copolymer, ethylene maleic anhydride copolymer, cross-linked carboxymethylcellulose, polyvinyl alcohol copolymers, cross-linked polyethylene oxide, combination thereof, or the like. These types of super absorbent materials may be combined with the elastomeric precursor material so that the grip elements include the superabsorbent materials therein, such as within the elastomeric base material 412 of the grip elements or other portions of the grip elements. This may allow the grip elements to absorb liquids, such as sweat of the wearer of the apparel. In some example embodiments, the superabsorbent materials may be added to the elastomeric precursor material with a proportion of about 1% to about 50% by weight. In other example embodiments, the superabsorbent materials may be added to the elastomeric precursor material with a proportion of about 4% to about 20% by weight. In yet other example embodiments, the superabsorbent materials may be added to the elastomeric precursor material with a proportion of about 6% to about 15% by weight. As described herein, the elastomeric precursor material may be deposited on the surface of the fabric 410 by screen printing. In this process, a screen with selective openings, corresponding to the pattern that is to be transferred onto the fabric, is aligned onto the surface of the fabric 410 and the elastomeric precursor material is selectively squeezed through the open regions of the screen and blocked by the closed regions of the screen. In this way, the elastomeric precursor material may be transferred onto the surface of the fabric 410 with the pattern on the screen. The squeezing of the elastomeric precursor material may be performed by a squeegee process, or generally by providing a force over the elastomeric precursor material on the screen to squeeze the elastomeric precursor material through the openings of the screen. The openings of the screen may be of any suitable size. In example embodiments, the screen mesh count may be in the range of about 40 to about 230. In other example embodiments, the screen mesh count may be in the range of about 70 to about 120. In still other example embodiments, the screen mesh count may be in the range of about 80 to 100.

Once the fluidic elastomeric precursor is dispensed on the surface of the fabric 410, such as by screen printing and/or nozzle spray and/or extrusion, the fluidic elastomeric precursor material may be cured. The cure process may be by any suitable mechanism, such as thermal cure, radiative cure, ultraviolet (UV) cure, or a combination of thermal and radiative cure. The cure process may cause evaporation of solvents in the elastomeric precursor material and/or crosslinking of resins in the elastomeric precursor material. For example, the cure process may drive crosslinking of polymeric compounds. In example embodiments, the cure process may be conducted at a temperature in the range of about 100° C. to about 250° C. In some example embodiments, the cure process may be conducted in the range of about 150° C. to about 220° C. In further example embodiments, the cure process may be conducted in the range of about 170° C. to about 200° C. The cure process may last for about 15 seconds to about 1 hour. As a non-limiting example, the cure may be conducted at 190° C. for 1 minute.

In example embodiments, the elastomeric base material 412 may be formed by deposition of different types of elastomeric materials. For example, a three-step process may involve forming a patterned layer of a first elastomeric material, a patterned layer of a second elastomeric material, and then a patterned layer of a third elastomeric material. In other words, this multi-layer (e.g., tri-layer) process may be used to make the elastomeric base material 412 with different materials. This multi-step process with different elastomeric materials may provide for the elastomeric base material 412 having a high level of grip (e.g., tackiness) with objects, while providing a reliable, non-delaminating interface with the fabric 410. In this process, the first layer may be a silicone clear base epoxy layer, second layer may be a glossy jelly layer and/or a glossy polymer/elastomeric layer, and the third layer may be a plastisol ink layer. The number and order of these layers is one example, and it should be understood that there may be any suitable number of layers, types of materials, and/or order of layers.

The embodiments, as disclosed herein, contemplates using multiple different layers of elastomeric base material 412 such that the initial layer contacting the fabric 410 may have a relatively high adherence strength to the fabric 410 compared to other elastomeric materials within the stack of elastomeric materials. Further still, in some cases, the initial layer may have a coefficient of thermal expansion (CTE) that is more closely matched to the CTE of the fabric 410 than subsequent layers of elastomeric materials. A low CTE mismatch between the initial layer of elastomeric base material 412 and the fabric 410 may reduce the possibility of delamination or peeling between the grip elements and the fabric 410, particularly during temperature changes, such as when the apparel is dried in a warm clothes dryer.

At block 404, embedded material of the grip elements may be applied on the portion of the garment. The embedded material of the grip elements may be grit 414. This grit 414 material may be sand, ceramic particles, engineered particles, metallic oxides, or similar materials. The grit 414 may be deposited over a portion or over the entirety of the one or more layers of elastomeric base material 412. The grit 414 may be deposited by scattering over the fabric 410 or by similar mechanisms as used for depositing the elastomeric precursor materials. As discussed herein, the grit 414 may be deposited such that there is an edge exclusion, where grit 414 is not provided within a predetermined distance of the edges of the one or more layers of elastomeric base material 412.

For example, screen printing may be used to deposit the grit 414 over at least a portion of the one or more layers of elastomeric base material 412. When using a screen printing process, the grit 414 may be disposed over the one or more layers of elastomeric base material 412 by use of a patterned screen. In some cases, the patterned screen for depositing the grit 414 may have a lower mesh count than the screen for depositing elastomeric precursor material. For example, the mesh count of the screen for depositing the grit 414 may be in the range of about 30 to about 80.

It should be understood that in some cases, the grit 414 may not be applied to some or all of the grip elements to be formed. For example, for some apparel there may be some grip elements that have grit 414 embedded therein, but also have some grip elements without any grit therein. In other example apparel, none of the grip elements may have grit 414 therein. In other words, in some cases, all of the grip elements of the apparel may only have the elastomeric base material 412 as provided by the processes of block 402. For example, a grip element may be formed by a first layer of a silicone clear base epoxy layer formed on the fabric 410, and then a second layer of a glossy jelly layer and/or a glossy polymer/elastomeric layer formed over at least a portion of the first layer, and then a third layer of a plastisol ink layer formed over at least a portion of the first and/or second layer.

At block 406, one or more layers of elastomeric overlying material of the grip elements may be formed on the portion of the garment. As an example, the one or more layers of overlying elastomeric material may be deposited over the grit 414 to from the elastomeric material 416 of the grip elements. The elastomeric material 416 may embed the grit 414 therein. In this way, the grit 414 is embedded and held within the elastomeric material, protruding from the surface of the formed grip element disposed on the fabric 410.

In some cases, the one or more layers of elastomeric overlying material may be formed in a manner similar to the formation of the one or more layers of the elastomeric base material 412. In other cases, there may be process and/or material differences between processes for forming the one or more layers of elastomeric overlying material and the one or more layers of the elastomeric base material 412. For example, the one or more layers of elastomeric overlying material may be formed by aligning and screen printing liquid elastomeric precursor material over the grit and the elastomeric base material 412, followed by a curing process. Such as process may be repeated for any number of desired layers of the elastomeric overlying material to form the final elastomeric material 416 with grit 414 embedded therein.

In some cases, the one or more layers of elastomeric overlying material may cover, rather than surround, the grit 414 at the surface of the elastomeric base material 412. Thus, the surface of the resulting grip element may be textured with elastomeric material 416 over its surface. In some cases, some of the grit 414 may be exposed at the surface and others of the grit 414 may be covered by the elastomeric material 416. In example embodiments, where at least some of the grit 414 is covered by elastomeric material 416 the covered portion over the grit 414 may be relatively thin, and during the course of use of the garment, and due to the forces associated therewith, the grit 414 may break through the surface of any elastomeric material 416 covering the grit 414.

In some cases, a different type and/or formulation of liquid elastomeric precursor may be used to form the one or more elastomeric overlying layers as compared to the one or more elastomeric base layers 412 to prevent covering the grit with elastomeric material. For example, the elastomeric overlying layers may be formed using a less viscous formulation of the liquid elastomeric precursor. A less viscous formulation of the liquid elastomeric precursor may be formed by increasing the ratio of solvent to elastomer resin, for example. As another example, the one or more elastomeric base layers 412 may be formed using plastisol, while the one or more elastomeric overlying layers may be formed using silicone.

It should be noted that some of the operations of method 400 may be performed out of the order presented, with additional elements, and/or without some elements. Some of the operations of method 400 may further take place substantially concurrently and, therefore, may conclude in an order different from the order of operations shown above.

Figure 5:
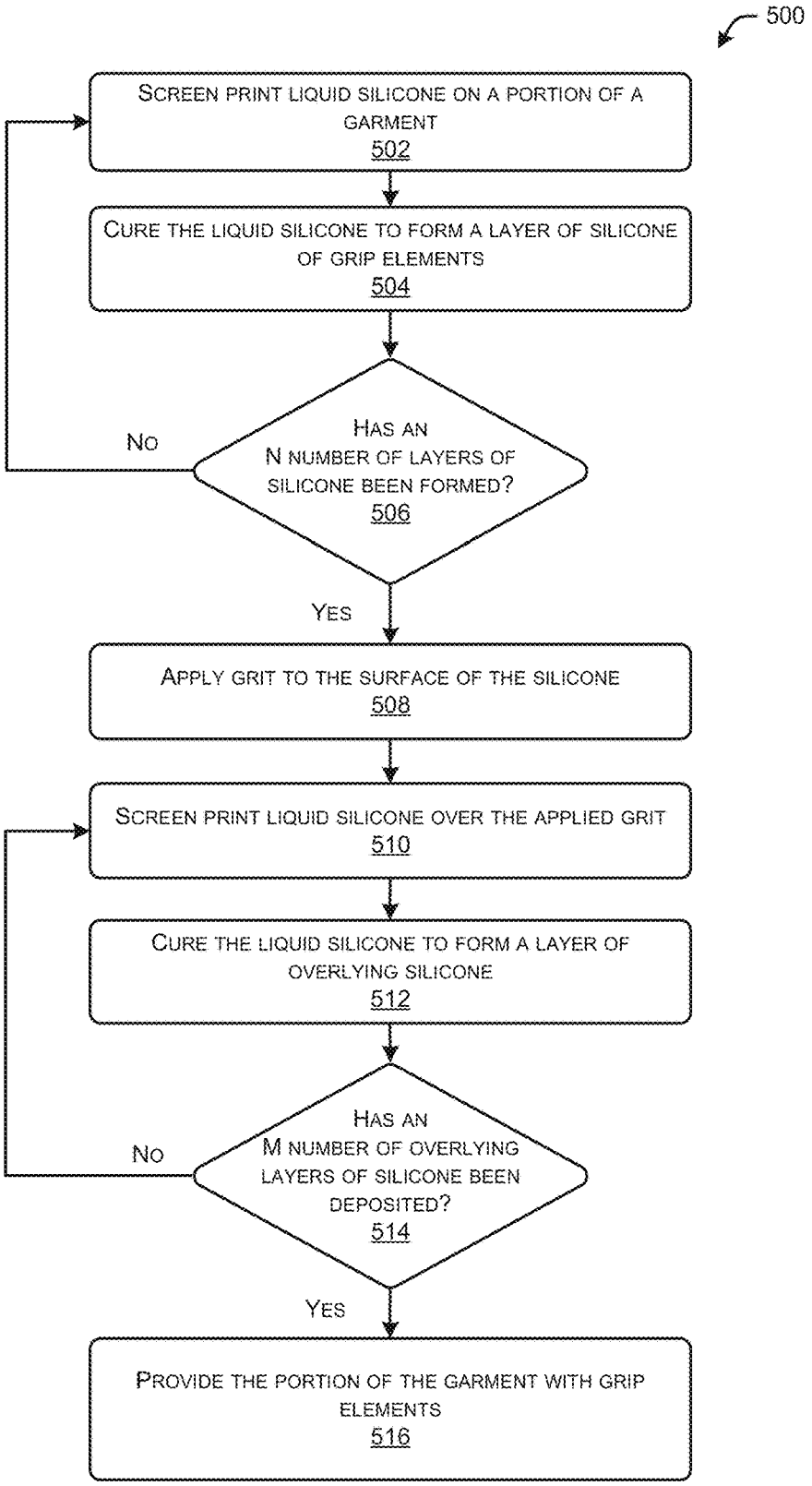
FIG. 5 illustrates a flow diagram of an example method for forming grip elements on a portion of a garment by screen printing a curable base material, in accordance with example embodiments of the disclosure.

FIG. 5 illustrates a flow diagram of an example method 500 for forming grip elements on a portion of a garment by screen printing a curable base material, in accordance with example embodiments of the disclosure. This method 500, in example embodiments, may be performed by one or more entities (e.g., different manufacturers) in one or more facilities (e.g., clothing factories). Method 500 may be a specific implementation of method 300 and method 400, as described in FIGS. 3 and 4, respectively.

At block 502, liquid silicone may be screen printed on a portion of a garment. The screen printing process may pattern the silicone to a desired pattern on a surface of fabric. Any suitable screen mesh and/or squeegee speed may be used for this process.

At block 504, the liquid silicone may be cured to form a layer of silicone of the grip elements. The cure processes may be performed at any suitable temperature and time, such as at 200 C for 1 minute. After cure, the silicone may harden, such as via polymeric cross-linking, to form a layer of base material on the fabric.

At block 506, it may be determined if an N number of layers of silicone have been deposited. In this case, N may be the number of layers of silicone to be deposited prior to providing the grit material thereon. If an N number of layers of silicone have not yet been deposited, then the method may return to block 502 to deposit an additional layer of silicone. If, on the other hand, N number of layers of silicone have been deposited on the portion of the garment, then the method may advance to block 508, where grit may be applied to the surface of the silicone. As discussed herein, the grit may be deposited by way of non-selective scattering, deposited by patterned and/or selective placement (e.g., screen printing, nozzle dispense, etc.), deposited in dry and/or powder form, and/or deposited in slurry form.

At block 510, liquid silicone may be screen printed over the applied grit. As discussed herein, the liquid silicone may be the same formulation as the liquid silicone used to form the silicone base prior to grit application, or it may be a different formulation. In some example embodiments, a thinner (i.e., less viscous) formulation of liquid silicone may be used in this process to prevent and/or reduce silicone from forming over the grit.

At block 512, the liquid silicone may be cured to form a layer of silicone over a portion of the grit. This cure process may be any suitable process, such as a thermal cure. This cure process may be the same or different process conditions as the cures used for the silicone layers deposited prior to the application of the grit.

At block 514, it may be determined if M layers of silicone has been deposited over the grit. In this case, M may correspond to the number of layers of silicone that are to be formed after the grit is applied. If M layers of silicone have not been formed, then the method 500 may return to block 510 to form an additional layer of silicone. In one the other hand M layers of silicone have been formed, then the method 500 may proceed to block 516. At block 516, the portion of the garment with the grip elements may be provided.

It should be noted that some of the operations of method 500 may be performed out of the order presented, with additional elements, and/or without some elements. Some of the operations of method 500 may further take place substantially concurrently and, therefore, may conclude in an order different from the order of operations shown above.

Figure 6A:
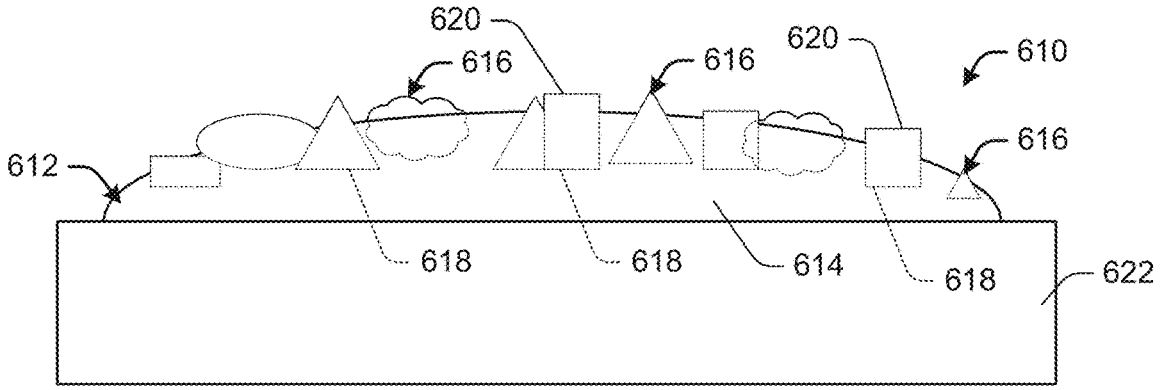
FIGS. 6A-6C illustrate sectional diagrams of grip elements formed on a portion of an apparel, where the grip elements include various type of grit materials, in accordance with example embodiments of the disclosure.
Figure 6B:
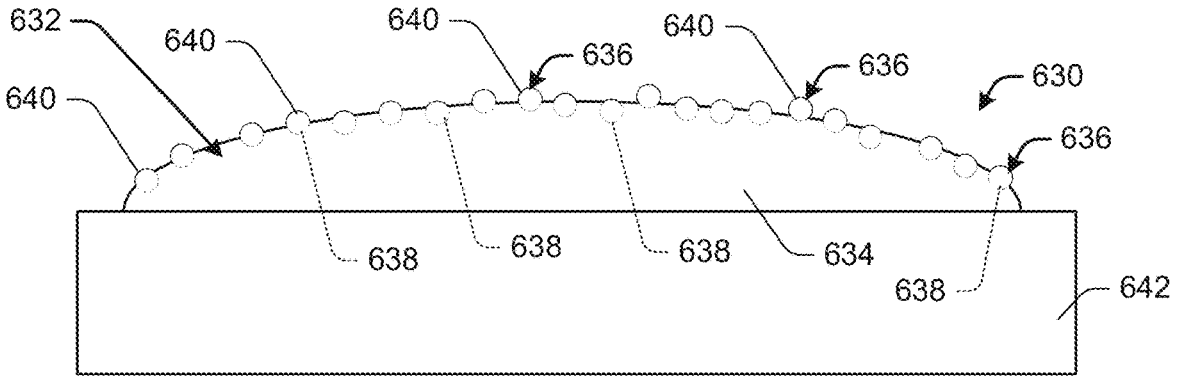
Figure 6C:
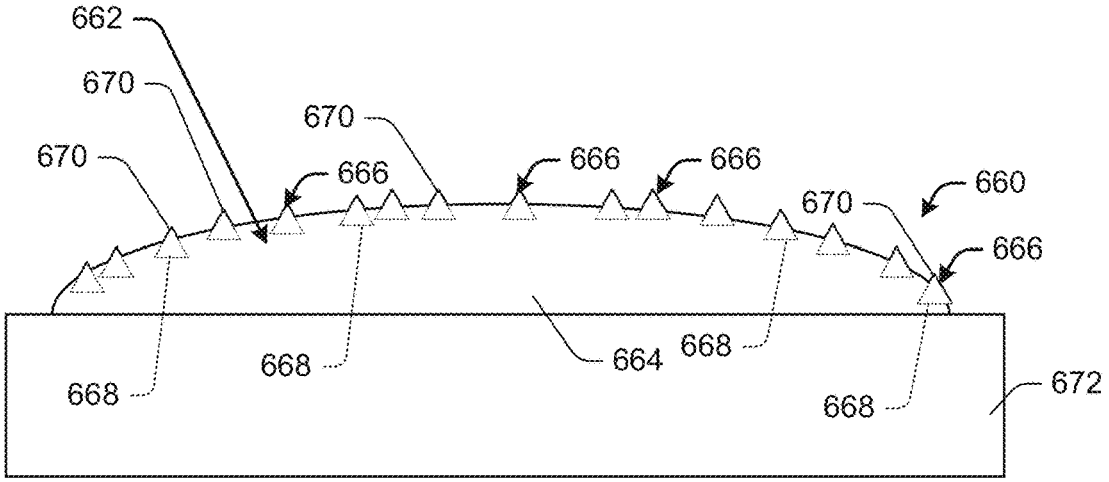

FIGS. 6A-6C illustrate sectional diagrams 610, 630, 660 of grip elements 614, 634, 664 formed on a portion 622, 642, 672 of an apparel, where the grip elements 612, 632, 662 include various type of grit materials 616, 636, 666, in accordance with example embodiments of the disclosure.

FIG. 6A illustrates the sectional diagram 610 where the grip element 612 may include the grit 616 that is of various shapes and sizes and embedded in elastomeric material 614. The grip element 612 may be disposed on fabric 622 of a garment. A first part 618 of the grit 616 may be embedded within the elastomeric material 614 of the grip elements 612, while a second part 620 of the grit 616 may protrude from the surface of the elastomeric material 614. The grit 616, in this case, may be any suitable grit material that may have relatively high variations in size and/or shape, such as, for example, sand. This type of grit 616 may be advantageous for providing enhanced grip to certain materials and/or types of objects relative to grit that may be more uniform and shape-controlled.

FIG. 6B illustrates the sectional diagram 630 where the grip element 632 may include the grit 636 that is of relatively uniform shapes and sizes and embedded in elastomeric material 634. Additionally, the grit 636 may have rounded and/or smooth surfaces. For example, in some cases, the grit 636 may have a substantially spherical shape. The grip element 632 may be disposed on fabric 642 of a garment. A first part 638 of the grit 636 may be embedded within the elastomeric material 634 of the grip elements 632, while a second part 640 of the grit 636 may protrude from the surface of the elastomeric material 634. The grit 636, in this case, may be any suitable grit material that may have relatively high uniformity in size and/or shape, as well as rounded surfaces. Examples of such grit 636 may be engineered particles, polished particles, alumina, silicon carbide, silica, etc. This type of grit 636 may be advantageous for providing enhanced grip to certain materials and/or types of objects relative to grit that may be less uniform, less shape-controlled, and/or less rounded.

FIG. 6C illustrates the sectional diagram 660 where the grip element 662 may include the grit 666 that is of relatively uniform shapes and sizes and embedded in elastomeric material 664. Additionally, the grit 666 may have pointy surfaces and/or surfaces with sharp edges. For example, in some cases, the grit 666 may have a substantially spherical shape. The grip element 662 may be disposed on fabric 672 of a garment. A first part 668 of the grit 666 may be embedded within the elastomeric material 664 of the grip elements 662, while a second part 670 of the grit 666 may protrude from the surface of the elastomeric material 664. The grit 666, in this case, may be any suitable grit material that may have relatively high uniformity in size and/or shape and may have sharp edges. This type of grit 666 may be advantageous for providing enhanced grip to certain materials and/or types of objects relative to grit that may be less uniform, less shape-controlled, and/or more rounded.

Figure 7:
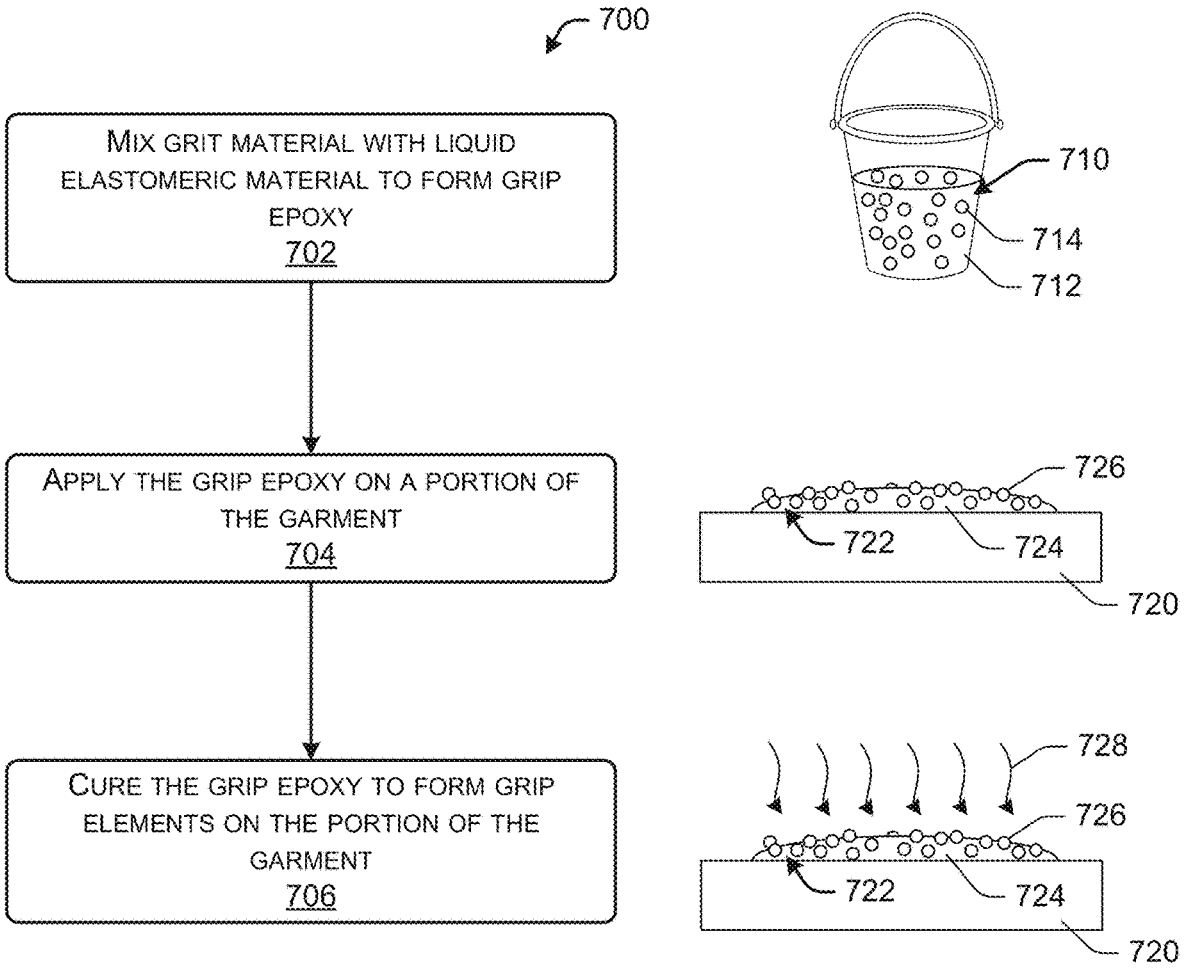
FIG. 7 illustrates a flow diagram of an example method for forming grip elements with a pre-mixed grip epoxy, in accordance with example embodiments of the disclosure.

FIG. 7 illustrates a flow diagram of an example method 700 for forming grip elements with a pre-mixed grip epoxy, in accordance with example embodiments of the disclosure. This method 700 may be used instead of or in addition to method 400 and/or method 500 to from grip elements on a surface of fabric of a garment. The pre-mixed grip epoxy may include grit therein.

At block 702, grit material may be mixed with liquid elastomeric material to form grip epoxy. This grip epoxy 710 may have the grit 714 in suspension within the liquid elastomeric material 712 and may need to be mixed and/or agitated before use. The grip epoxy 710, in example embodiments, may have various types of grit 714 mixed therein, such as sand, dust, engineered particles, silica particles, alumina particles, other metal-oxide particles, ceramic particles, silicon carbide particles, combinations thereof, or the like. The liquid elastomeric material may be formulated to have a viscosity that is favorable for keeping the grit 714 in suspension and also for application on fabric.

At block 704, the grip epoxy may be applied on a portion of a garment. The application of the grip epoxy 710 may be by any suitable mechanism as described herein. For example, the grip epoxy 710 may be applied on the portion 720 of the garment to form a staged grip element 722, with an elastomeric portion 724 and grit 726 embedded therein, using screen printing. An appropriate mesh sized screen may be used to allow the patterned application of the grip epoxy 710 without separation of the grit 714 from the liquid elastomeric material 712 as the grip epoxy 710 passes through the screen.

At block 706, the grip epoxy may be cured to form the grip elements on the portion of the garment. The cure 728 may be of any suitable form, such as thermal cure, or any type of radiative cure (e.g., ultra-violet cure), or any combination of thermal and radiative cures. After curing, the grip element 722 may be attached to the portion 720 of the garment with cured elastomeric portion and grit 726 embedded therein.

It should be understood that in some cases, a hybrid process of forming the grip elements may be used where aspects of method 400 of FIG. 4 may be combined with aspects of method 700. For example, underlying elastomeric material without grit may be formed on fabric and then, elastomeric material with grit embedded therein may be formed over the underlying elastomeric material by the processes described herein using pre-mixed grip epoxy.

It should be noted that some of the operations of method 700 may be performed out of the order presented, with additional elements, and/or without some elements. Some of the operations of method 700 may further take place substantially concurrently and, therefore, may conclude in an order different from the order of operations shown above.

Figure 8A:
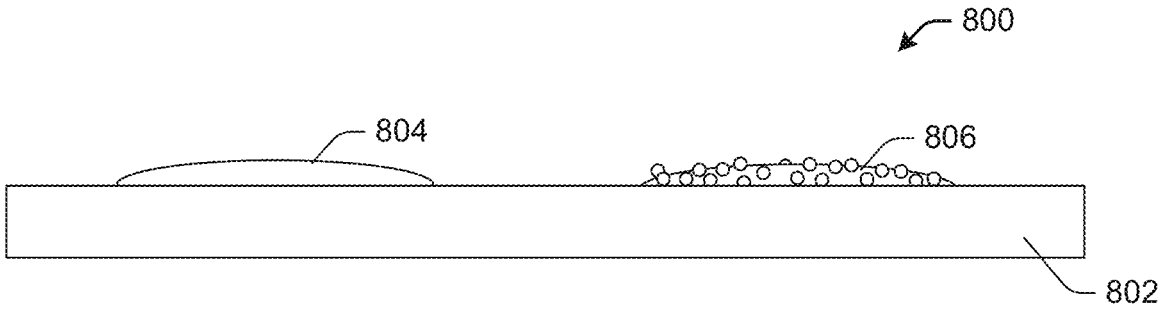
FIGS. 8A-8C illustrate sectional diagrams of various placements of grip elements with and without grit, in accordance with example embodiments of the disclosure.
Figure 8B:
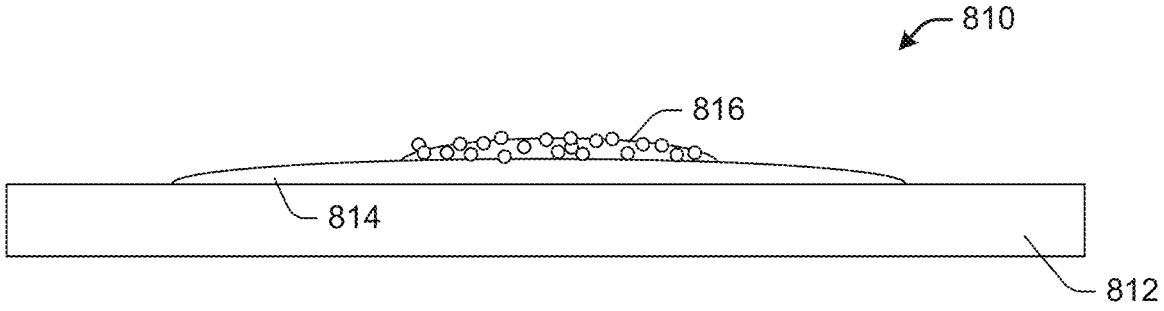
Figure 8C:
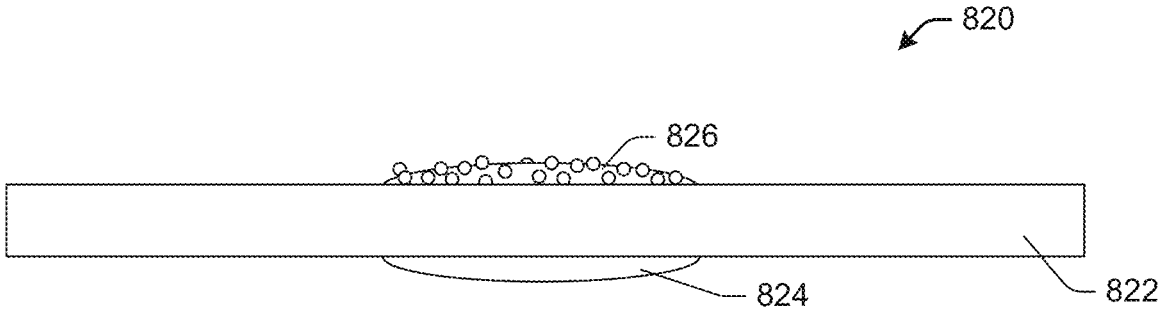

FIGS. 8A-8C illustrate sectional diagrams 800, 810, 820 of various placements of grip elements 804, 806, 814, 816, 824, 826 with and without grit, in accordance with example embodiments of the disclosure. Although various combinations and types of grip elements 804, 806, 814, 816, 824, 826 are discussed herein, there may be other suitable combinations and/or types of grip elements as disposed on a garment.

FIG. 8A illustrates a sectional diagram 800 with a fabric 802 on which there is disposed a first grip element 804 without any grit therein and a second grip element 806 with grit embedded therein. Although two grip elements 804, 806 are illustrated, there may be any number of grip elements where some grip elements may have grit embedded therein and others may not have grit embedded therein. Furthermore, although the grip elements 804, 806 are depicted with substantially a similar height and/or protrusion from the fabric 802, it should be understood that the grip element 804 without grit and the grip element 806 with grit may be of different protrusions from the fabric 802. For example, in some cases, the grip element 804 without grit may have a greater protrusion from the fabric 802 than the grip element 806 with grit embedded therein. Further still, although the grip element 806 appears to be formed by the method 700 of FIG. 7, where a pre-mixed grip epoxy is used, it should be understood that any suitable mechanism may be used to form the grip element 806, such as, but not limited to method 400 of FIG. 4 and/or method 500 of FIG. 5. Additionally, it should be understood that the configuration of grip elements 804, 806 may be combined with any other configuration of grip elements, such as those that are depicted in FIG. 8B or 8C.

FIG. 8B illustrates a sectional diagram 810 with a fabric 812 on which there is disposed a first grip element 814 without any grit therein and a second grip element 806 with grit embedded therein and disposed over the first grip element 814. Although two grip elements 814, 816 are illustrated, there may be any number of grip elements where some grip elements may have grit embedded therein and others may not have grit embedded therein. Furthermore, it should be understood that the configuration of grip elements 814, 816 may be combined with any other configuration of grip elements, such as those that are depicted in FIG. 8A or 8C. Further still, although the grip element 816 appears to be formed by the method 700 of FIG. 7, where a pre-mixed grip epoxy is used, it should be understood that any suitable mechanism may be used to form the grip element 816, such as, but not limited to method 400 of FIG. 4 and/or method 500 of FIG. 5.

FIG. 8C illustrates a sectional diagram 820 with a fabric 822 on which there is disposed a first grip element 824 without any grit therein on an inner side of the fabric 820 and a second grip element 826 with grit embedded therein and on the outer side of the fabric 820. In this case, when the garment is worn, the first grip element 824 may be in contact with the wearer's body, while the second grip element 824 may functionally increase contact friction of any object with which the garment is in contact. Although two grip elements 814, 816 are illustrated, there may be any number of grip elements where some grip elements may have grit embedded therein and others may not have grit embedded therein. Additionally, although the grip elements 824 and 826 are depicted as aligned on either side of the fabric 822, the grip elements 824, 826 may be disposed in any suitable relative position to each other. In some cases, having the grip elements 824, 826 aligned on either side of the fabric 820 may increase the relative amounts of uncovered fabric (e.g., fabric area on which a grip element is not disposed), resulting in improved breathability of the garment and improved comfort for the wearer of the garment. It should be understood that the configuration of grip elements 824, 826 may be combined with any other configuration of grip elements, such as those that are depicted in FIG. 8B or 8C. Further still, although the grip element 826 appears to be formed by the method 700 of FIG. 7, where a pre-mixed grip epoxy is used, it should be understood that any suitable mechanism may be used to form the grip element 826, such as, but not limited to method 400 of FIG. 4 and/or method 500 of FIG. 5.

FIGS. 9A-9G illustrate diagrams of various patterns 900, 910, 920, 930, 940, 950, 960 of grip elements that may be disposed on an apparel, in accordance with example embodiments of the disclosure. It should be noted that these patterns 900, 910, 920, 930, 940, 950, 960 are examples and the disclosure herein contemplate any variety of patterns of grip elements, with and/or without grit, as disposed on garments or apparels.

Figure 9A:
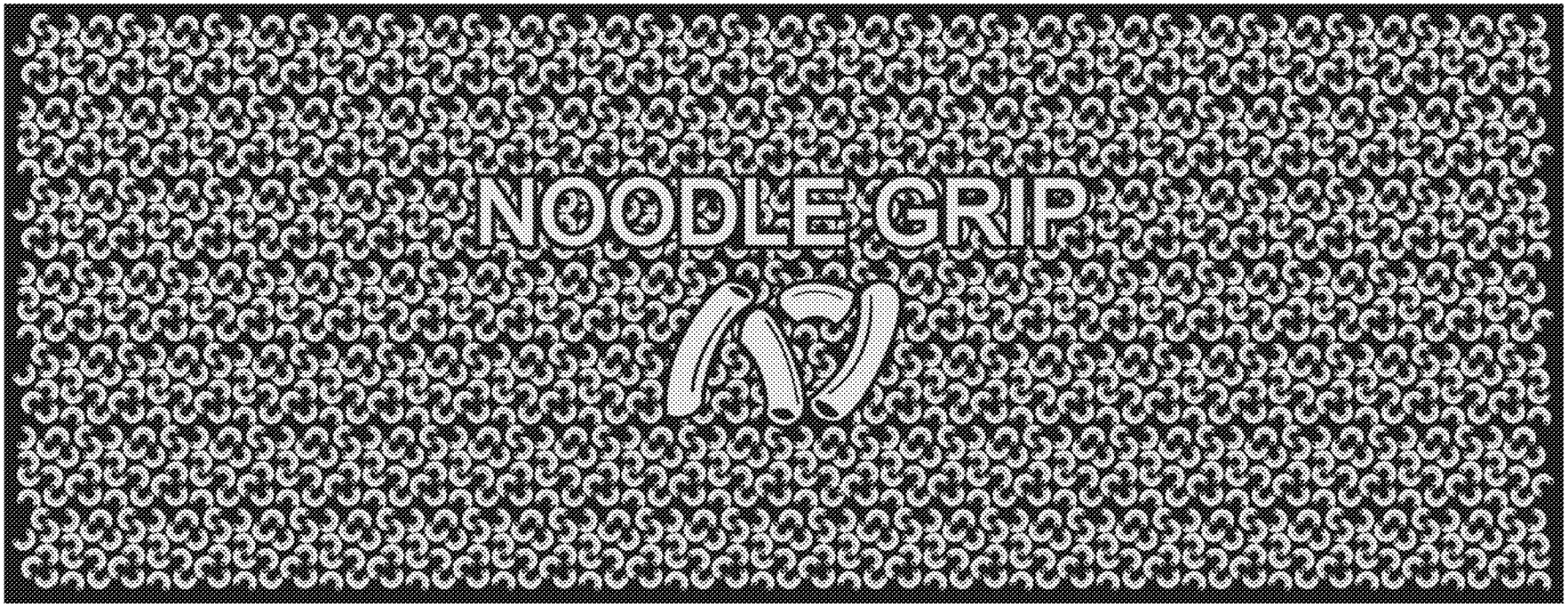

FIG. 9A illustrates a diagram of the pattern 900 of grip elements that that resemble macaroni, pasta, and/or noodles, in accordance with example embodiments of the disclosure. Any portion of the pattern 900 may be any suitable color (e.g., yellow, white, etc.) and any portion of the pattern 900 may include any combination of grip elements with and/or without grit therein. The pattern 900 may be disposed on any suitable portion of any type of garment, such as on the back/shoulder area of a shirt and/or the legs of a pant. The aerial density of the pattern 900 may be the percentage of area of this pattern 900 that is covered by grip elements and may be in the ranges disclosed herein.

Figure 9B:
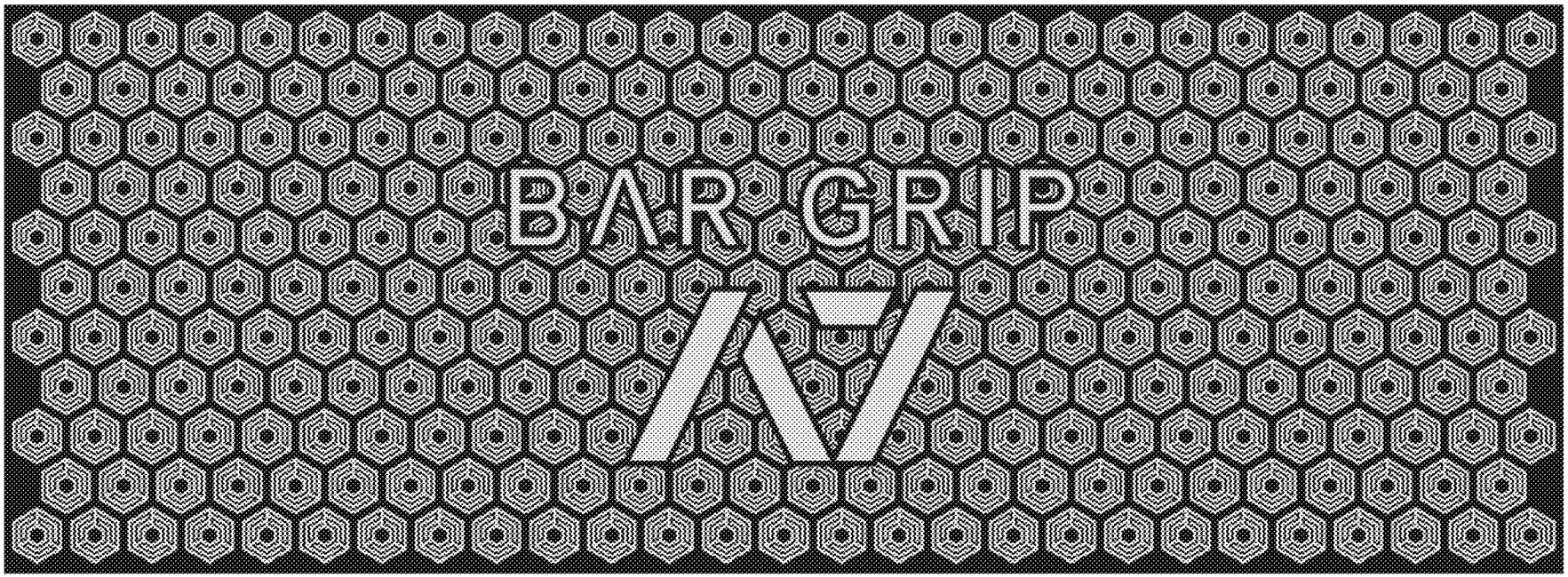

FIG. 9B illustrates a diagram of the pattern 910 of grip elements that that include a honeycomb pattern, in accordance with example embodiments of the disclosure. Any portion of the pattern 910 may be any suitable color (e.g., yellow, green, blue, etc.) and any portion of the pattern 910 may include any combination of grip elements with and/or without grit therein. The pattern 910 may be disposed on any suitable portion of any type of garment, such as on the back/shoulder area of a shirt and/or the legs of a pant. The aerial density of the pattern 910 may be the percentage of area of this pattern 910 that is covered by grip elements and may be in the ranges disclosed herein.

Figure 9C:
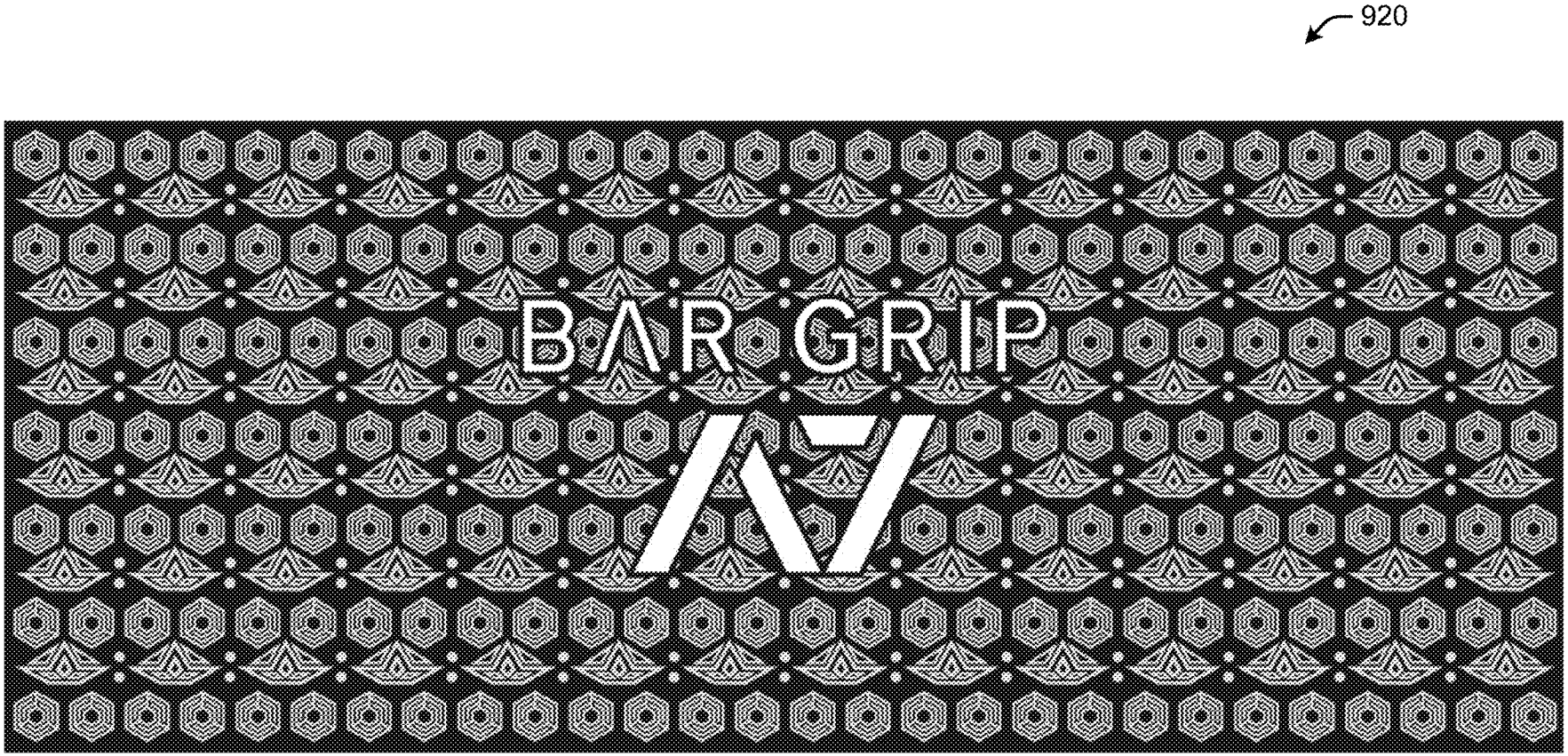

FIG. 9C illustrates a diagram of the pattern 920 of grip elements that that include a multi-shape pattern, in accordance with example embodiments of the disclosure. Any portion of the pattern 920 may be any suitable color (e.g., red, green, magenta, etc.) and any portion of the pattern 920 may include any combination of grip elements with and/or without grit therein. The pattern 920 may be disposed on any suitable portion of any type of garment, such as on the back/shoulder area of a shirt and/or the legs of a pant. The aerial density of the pattern 920 may be the percentage of area of this pattern 920 that is covered by grip elements and may be in the ranges disclosed herein.

Figure 9D:
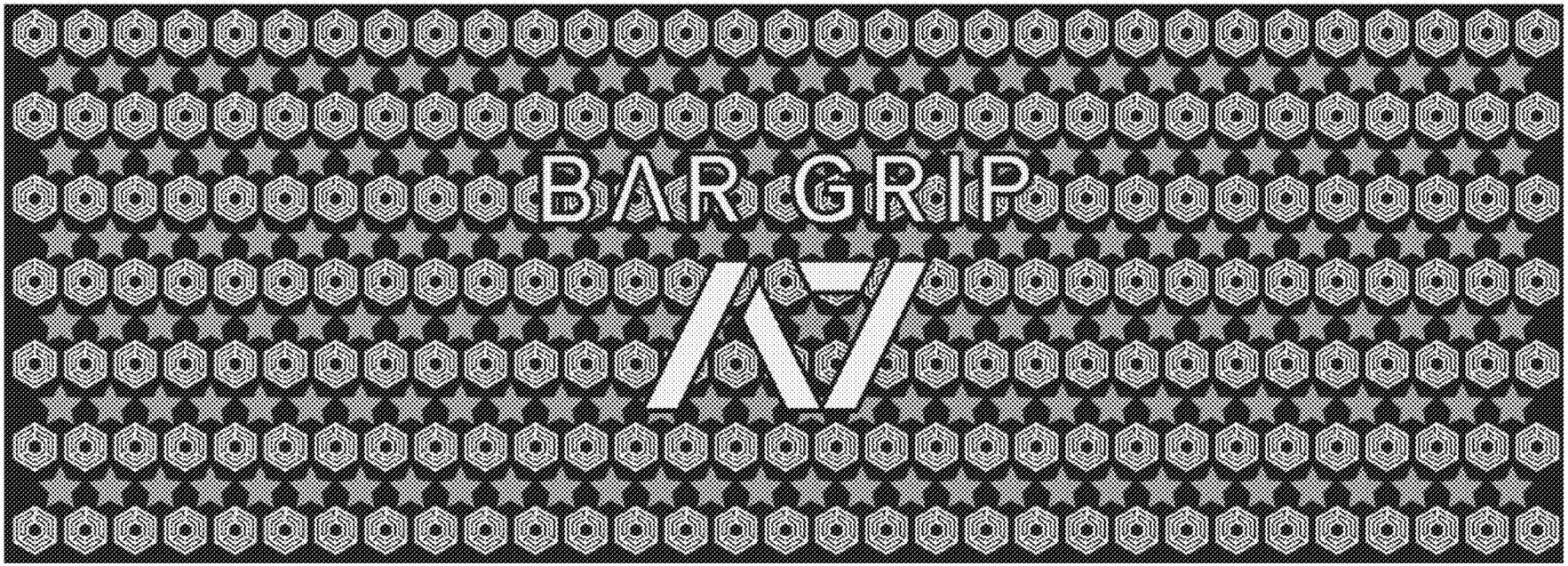

FIG. 9D illustrates a diagram of the pattern 930 of grip elements that that include a star and open hexagon pattern, in accordance with example embodiments of the disclosure. Any portion of the pattern 930 may be any suitable color (e.g., mauve, indigo, orange, etc.) and any portion of the pattern 930 may include any combination of grip elements with and/or without grit therein. The pattern 930 may be disposed on any suitable portion of any type of garment, such as on the back/shoulder area of a shirt and/or the legs of a pant. The aerial density of the pattern 930 may be the percentage of area of this pattern 930 that is covered by grip elements and may be in the ranges disclosed herein.

Figure 9E:
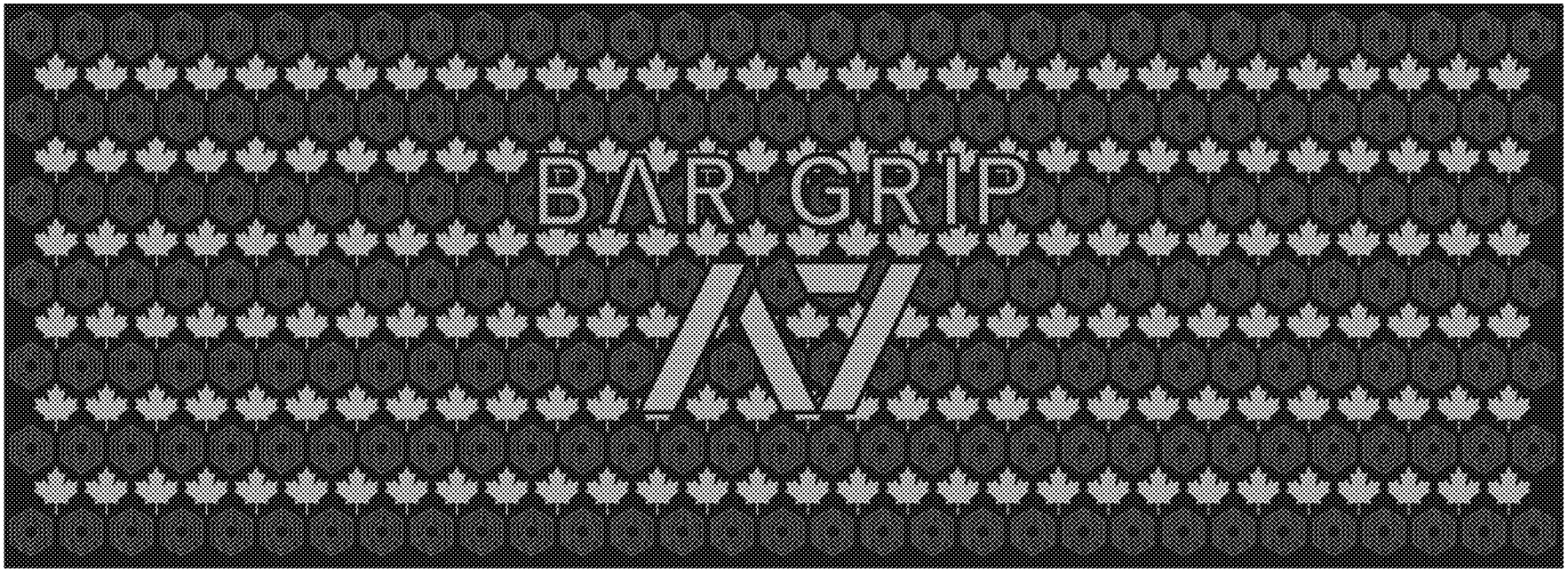

FIG. 9E illustrates a diagram of the pattern 940 of grip elements that that include a maple leaf and open hexagon pattern, in accordance with example embodiments of the disclosure. Any portion of the pattern 940 may be any suitable color (e.g., red, green, magenta, etc.) and any portion of the pattern 940 may include any combination of grip elements with and/or without grit therein. The pattern 940 may be disposed on any suitable portion of any type of garment, such as on the back/shoulder area of a shirt and/or the legs of a pant. The aerial density of the pattern 940 may be the percentage of area of this pattern 940 that is covered by grip elements and may be in the ranges disclosed herein.

FIG. 9F illustrates a diagram of the pattern 950 of grip elements that that resemble the flag of the United Kingdom (i.e., the Union Jack), in accordance with example embodiments of the disclosure. Any portion of the pattern 950 may be any suitable color (e.g., red, white, blue, etc.) and any portion of the pattern 950 may include any combination of grip elements with and/or without grit therein. The pattern 950 may be disposed on any suitable portion of any type of garment, such as on the back/shoulder area of a shirt and/or the legs of a pant. The aerial density of the pattern 950 may be the percentage of area of this pattern 950 that is covered by grip elements and may be in the ranges disclosed herein.

Figure 9G:
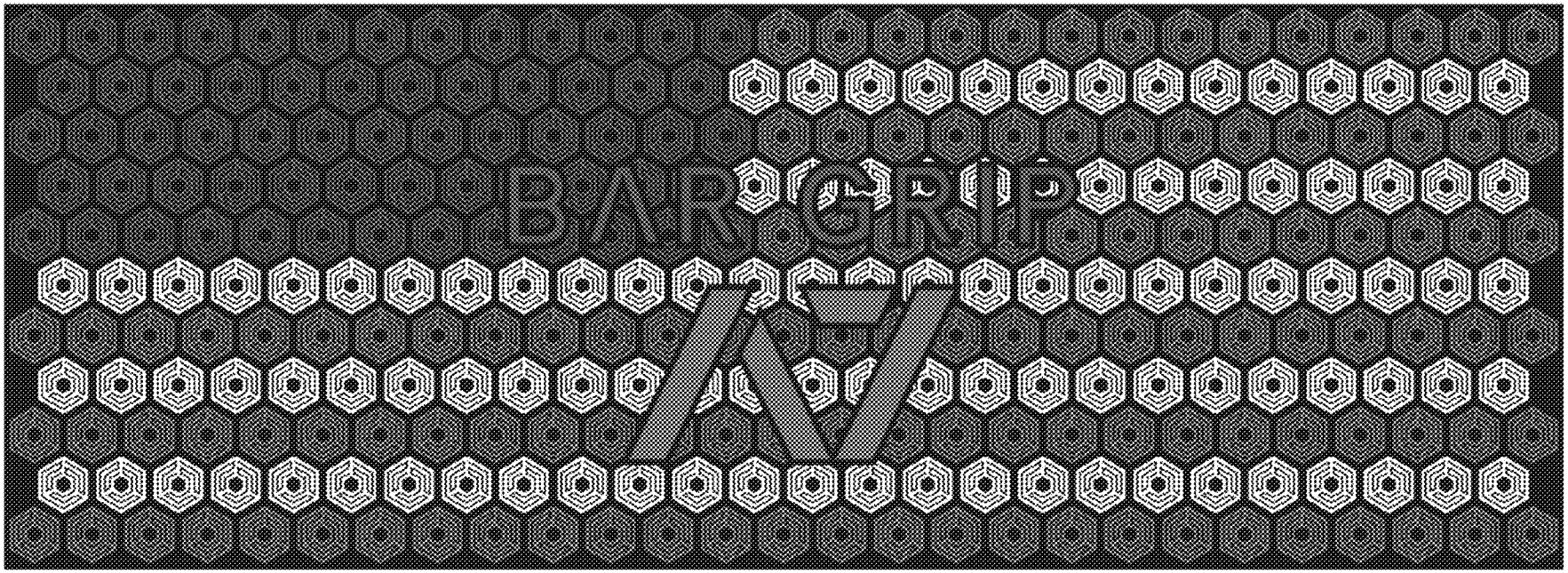

FIG. 9G illustrates a diagram of the pattern 960 of grip elements that that resemble the flag of the United States of America (i.e., the Stars and Stripes), in accordance with example embodiments of the disclosure. Any portion of the pattern 960 may be any suitable color (e.g., red, white, blue, etc.) and any portion of the pattern 960 may include any combination of grip elements with and/or without grit therein. The pattern 960 may be disposed on any suitable portion of any type of garment, such as on the back/shoulder area of a shirt and/or the legs of a pant. The aerial density of the pattern 960 may be the percentage of area of this pattern 960 that is covered by grip elements and may be in the ranges disclosed herein.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

The disclosure is described above with reference to block and flow diagrams of system(s), methods, apparatuses, and/or clothing according to example embodiments of the disclosure. It will be understood that one or more blocks of the block diagrams and flow diagrams, and combinations of blocks in the block diagrams and flow diagrams, respectively, can be implemented by one or more different entities on one or more different equipment. Likewise, some blocks of the block diagrams and flow diagrams may not necessarily need to be performed in the order presented, or may not necessarily need to be performed at all, according to some embodiments of the disclosure.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparel, comprising:

a fabric having a surface;

a first grip element disposed on the surface, the first grip element comprising:

first elastomeric material in contact with the surface; and grit material at least partially embedded in the elastomeric material, such that at least some of the grit material at least partially protrudes from a surface of the elastomeric material, while at least a portion of the grit material is surrounded by the elastomeric material, wherein the first grip element defines at least one opening within an outer border of the first grip element where the fabric is uncovered by the first grip element, and wherein the first grip element has a thickness of at least 0.1 millimeters; and a second grip element disposed on the surface, second grip element comprising a second elastomeric material and lacking any grit material.

2. The apparel of claim 1, wherein the apparel is a shirt and wherein the first grip element is disposed on a torso of the shirt a second grip element lacking any of the grit material.

3. The apparel of claim 1, wherein the elastomeric material comprises at least one of plastisol or silicone.

4. The apparel of claim 1, wherein the grit material comprises at least one of sand, silica, silicon carbide, or alumina.

5. The apparel of claim 1, further comprising a third grip element having a different shape than the first grip element.

6. The apparel of claim 1, further comprising:

a plurality of grip elements, wherein the first grip element is one of the plurality of grip elements, wherein the plurality of grip elements defines a pattern, and wherein the pattern has an aerial density of less than 75%.

7. The apparel of claim 1, wherein the grip element is a first grip element, the apparel further comprising:

the first grip element is a first color and the second grip element is a second color.

8. The apparel of claim 1, wherein the grip element is a first grip element, the apparel further comprising:

wherein the first grip element is disposed overlying the second grip element.

9. The apparel of claim 1, wherein the grip element is a first grip element and the surface is a first surface, the apparel further comprising:

a second surface of the fabric, the second surface opposing the first surface; and a second grip element, wherein the second grip element is disposed on the second surface.

10. The apparel of claim 1, wherein the grip element is a first grip element and the surface is a first surface associated with a first portion of the apparel, the apparel further comprising:

a second surface associated with a second portion of the apparel; and a third grip element disposed on the second portion of the apparel.

11. The apparel of claim 1, wherein the first grip element has a thickness of at least 1 millimeters.

12. The apparel of claim 1, wherein the fabric comprises at least one of cotton, rayon, polyester, or spandex.

13. The apparel of claim 1, wherein the apparel is a shirt and wherein the first grip element is disposed on a shoulder portion of the shirt.

14. A method to form an apparel, comprising:

providing a portion of the apparel having a surface;

forming, using screen printing, a first one or more layers of elastomeric material on the surface;

disposing grit onto at least a portion of the first one or more layers of elastomeric material on the surface; and forming a second one or more layers of elastomeric material over at least a portion of the grit, such that the at least the portion of the grit is at least partially embedded in the second one or more layers of elastomeric material and partially protrudes from a surface of the second one or more layers of elastomeric material.

15. The method to form the apparel of claim 14, wherein the portion of the apparel is a first portion of the apparel, the method further comprising:

attaching the first portion of the apparel to a second portion of the apparel.

16. The method to form the apparel of claim 15, further comprising:

forming a third one or more layers of elastomeric material on a second surface of the second portion of the apparel.

17. The method to form the apparel of claim 14, wherein forming the first one or more layers of elastomeric material further comprises:

depositing liquid elastomeric material onto the surface through a patterned screen; and curing the liquid elastomeric material by heating the liquid elastomeric material.

18. The method to form the apparel of claim 17, wherein the liquid elastomeric material is at least one of liquid plastisol or liquid silicone.

19. A method to form an apparel, comprising:

mixing grit into liquid elastomeric material to form grip epoxy;

aligning a first patterned screen onto a first surface of a first portion of the apparel;

depositing a first portion of the grip epoxy onto the first surface of the first portion of the apparel through the first patterned screen;

curing the first portion of the grip epoxy to form one or more first grip elements, such that at least the portion of the grit is at least partially embedded in cured elastomeric material and partially protrudes from the cured elastomeric material; and attaching the first portion of the apparel to a second portion of the apparel.

20. The method to form an apparel of claim 19, further comprising:

aligning a second patterned screen onto a second surface of the second portion of the apparel;

depositing a second portion of the grip epoxy onto the second surface of the second portion of the apparel through the second patterned screen; and curing the second portion of the grip epoxy to form one or more second grip elements.

* * * * *